US012442253B2

(12) United States Patent
Ishizuka

(10) Patent No.: US 12,442,253 B2
(45) Date of Patent: Oct. 14, 2025

(54) TWIN BIT

(71) Applicant: METAL TOOL INC, Aichi (JP)

(72) Inventor: Takemi Ishizuka, Aichi (JP)

(73) Assignee: METAL TOOL INC, Aichi (JP)

( * ) Notice: Subject to any disclaimer, the term of this patent is extended or adjusted under 35 U.S.C. 154(b) by 0 days.

(21) Appl. No.: 18/971,905

(22) Filed: Dec. 6, 2024

(65) Prior Publication Data

US 2025/0101811 A1 Mar. 27, 2025

Related U.S. Application Data

(63) Continuation of application No. PCT/JP2023/031222, filed on Aug. 29, 2023.

(30) Foreign Application Priority Data

Sep. 12, 2022 (JP) ..... 2022-144461

(51) Int. Cl.
*E21B 10/54* (2006.01)

(52) U.S. Cl.
CPC ..... *E21B 10/54* (2013.01)

(58) Field of Classification Search
CPC ..... E21B 10/54; E21B 10/43
See application file for complete search history.

(56) References Cited

U.S. PATENT DOCUMENTS 3,426,860 A * 2/1969 Petersen ..... E21B 10/42 175/392
3,999,620 A * 12/1976 Watson ..... B23B 51/04 175/420.1
4,488,606 A 12/1984 Inoue
5,497,843 A * 3/1996 Burns ..... E21B 10/44 175/413
11,795,765 B2 * 10/2023 Ishizuka ..... E02D 5/56
12,320,199 B1 * 6/2025 Morin ..... E21B 10/5673
2023/0374866 A1 * 11/2023 Rivera, Jr. ..... E21B 10/5673

FOREIGN PATENT DOCUMENTS

CN 2793292 Y 7/2006
CN 105569583 A 5/2016
CN 208040308 U 11/2018
CN 209308637 U 8/2019
CN 110219588 A 9/2019
CN 113994067 A 1/2022
(Continued)

OTHER PUBLICATIONS

Search Report for PCT/JP2023/031222 filed on Aug. 29, 2023, 17 pages.

(Continued)

*Primary Examiner* — Catherine Loikith
(74) *Attorney, Agent, or Firm* — Lee & Hayes, P.C.

(57) ABSTRACT

According to one embodiment, a twin bit includes a main bit and an auxiliary bit. A carbide tip having a mountain shape protruding in an excavation direction is arranged at least on a top portion and a bottom portion that are located on a front end of a base portion of each of the main bit and the auxiliary bit. An apex portion of the mountain shape of the carbide tip of the auxiliary bit is located further behind an apex portion of the mountain shape of the carbide tip of the main bit in the excavation direction.

6 Claims, 15 Drawing Sheets

(56) References Cited

FOREIGN PATENT DOCUMENTS

| | | | |
|---|---|---|---|
| JP | S59-228587 | A | 12/1984 |
| JP | H4-319195 | A | 11/1992 |
| JP | H11-311082 | A | 11/1999 |
| JP | 2011236644 | A | 11/2011 |
| JP | 2015-1112 | A | 1/2015 |
| JP | 2016-223196 | A | 12/2016 |
| JP | 6472150 | B1 | 2/2019 |
| JP | 2020125646 | A | 8/2020 |
| JP | 2022-47086 | A | 3/2022 |
| JP | 2022-64272 | A | 4/2022 |

OTHER PUBLICATIONS

Chinese Office Action for CN Patent Application 2023800448231, dated Feb. 21, 2025, 13 Pages.
Chinese Office Action mailed on Jun. 22, 2025, for Chinese Patent Application No. 202380044823.1, a foreign counterpart of U.S. Appl. No. 18/971,905, 14 pages.

* cited by examiner

TWIN BIT

CROSS-REFERENCE TO RELATED APPLICATIONS

This application is a Continuation application of PCT No. PCT/JP2023/031222, filed Aug. 29, 2023 and based upon and claims the benefit of priority from prior Japanese Patent Application No. 2022-144461, filed Sep. 12, 2022, the entire contents of all of which are incorporated herein by reference.

BACKGROUND OF THE INVENTION

1. Field of the Invention

The present invention relates to an excavation tool attached to a front end of a casing and particularly relates to a twin bit including the combination of a main bit and an auxiliary bit.

2. Description of the Related Art

As a pile construction method of pouring concrete into the ground and forming a pile, the all-casing method, which comprises press-fitting a casing tube in the ground, excavating and an evacuating soil and sand by means of a grab bucket while protecting a hole wall, and pouring concrete into the hole made by the excavation is generally known. In this all-casing method, cutter bits for inner, middle, and external blades are attached to the front end of the casing tube via a bit attachment holder, and excavation by means of cutter bits is performed by rotating the casing tube.

Here, according to a related art, as such a cutter bit, the cutter bit for excavation attached to the front end of the casing pipe along the circumferential direction of the casing pipe and comprising a head portion having a blade body made of carbide tip on its front end, and a leg portion on which a fixing means for the holder fixed to the casing pipe is provided.

However, the related art only teaches a cutter bit for excavation, and does not teach the main bit and auxiliary bit adjusting the cutting edge positions of the main bit and auxiliary together to make widths and angles in excavation positions of these two cutting edges variable.

BRIEF SUMMARY OF THE INVENTION

The present invention takes this problem into consideration and aims to provide a twin bit in which the main bit and auxiliary bit adjust the cutting edge positions of the main bit and auxiliary together to make widths and angles in excavation positions of these two cutting edges variable.

In order to solve the above problem, a twin bit of an embodiment of the present invention comprises a main bit and an auxiliary bit wherein each of the main bit and the auxiliary bit includes at least on top and bottom of a front end of a base portion, a carbide tip in a mountain shape protruding in the excavation direction, and wherein an apex portion of the mountain shape of the carbide tip of the auxiliary bit is located further behind the apex portion of the mountain shape of the carbide tip of the main bit in the excavation direction.

The present invention can provide a twin bit in which the main bit and auxiliary bit adjust the cutting edge positions of the main bit and auxiliary together to make widths and angles in excavation positions of these two cutting edges variable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiment of the present invention will be described with reference to the drawings.

A twin bit of the present embodiment has the following features:

(1) A main bit and an auxiliary bit are installed to be next to each other in a direction orthogonal to an excavation direction, and a cutting edge of an auxiliary bit is located on the rear in the excavation direction, compared to a cutting edge of the main bit. This configuration is called a staggered configuration. This configuration reduces the load on the inner (or outer) plate of the casing and prevents the build-up of excavation soil (or swarf) that occurs in the excavation with a single cutting edge, increasing the efficiency of the excavation.

(2) The base portion shape of the cutting edge of the main bit can be selected from either a straight shape or an inclined shape in which the base material is angled. Furthermore, by adjusting the positions of the cutting edges of the main bit and auxiliary bit, widths and angles in excavation positions of both cutting edges can be set. Therefore, the excavation position of the cutting edge is broadened, the load on the inner plate (or outer plate) of the casing is further reduced. Further, not only the build-up of the excavated soil (or swarf) can be further reduced but also the flow of the excavated soil (or swarf) can be controlled to move upwards.

(3) An auxiliary carbide tip is provided on a base material of the cutting edge. Thus, wear resistance can be increased. The hardness of the carbide tip can be freely selected according to excavation targets.

(4) The twin bit of the present embodiment can rotate in both directions. Therefore, excavate in both forward and reverse directions can be performed.

First Embodiment

Figure 1:
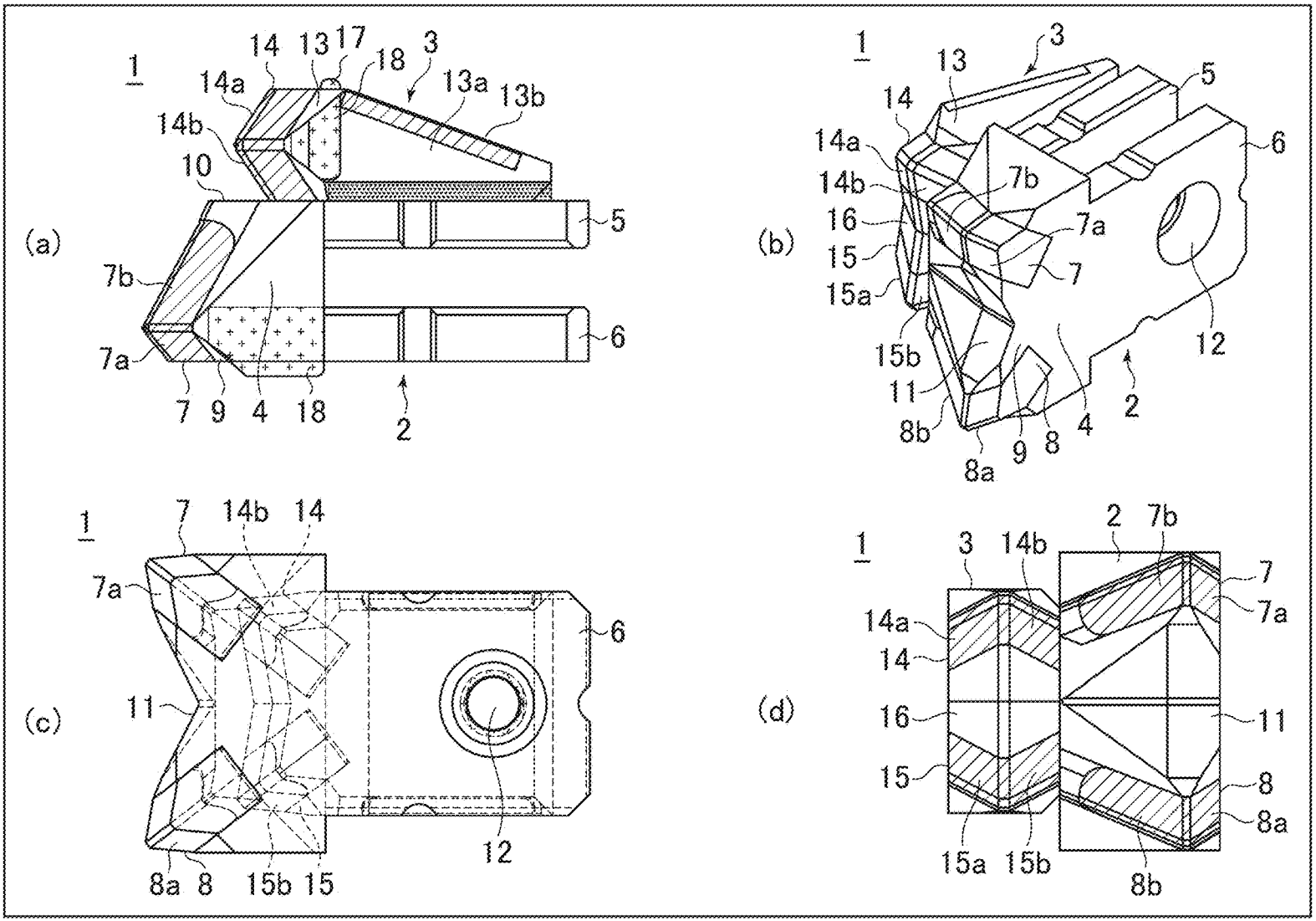
FIG. 1 is a diagram of a twin bit of a first embodiment of the present invention.

FIG. 1 (*a*) to FIG. 1 (*d*) show and explain the configuration of a twin bit of the first embodiment of the present invention. More specifically, FIG. 1 (*a*) shows a plan view of the twin bit, FIG. 1 (*b*) shows a perspective view of the twin bit, FIG. 1 (*c*) shows a side view of the twin bit, and FIG. 1 (*d*) shows a front view of the twin bit, for explanations. A main bit of the twin bit is straight-shaped and is an external-blade, and an auxiliary bit of the twin bit is a middle-blade attached to the inside. By making the auxiliary bit the middle-blade, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 1 (*a*) alone.

As shown in these diagrams, a twin bit 1 is configured such that blade portions of the front ends of a main bit 2 and an auxiliary bit 3 are staggered toward the rear in the excavation direction.

The main bit 2 is constituted by a base portion 4 and two leg portions 5 and 6 extending from the base portion 4. The base portion 4 side is hereinafter referred to as the front end of the twin bit 1 as well, and the leg portions 5 and 6 side is referred to as the attachment side to the casing or the rear end of the twin bit 1 as well. The direction which the front end faces is the excavation direction, and the direction orthogonal to the excavation direction is a hole wall direction or a pile core direction (also referred to as the thickness direction of the twin bit 1). The excavation direction and the directions orthogonal to the hole wall direction or pile core direction are referred to as the width direction of the twin bit 1.

Here, the pile core direction is "the center of the pile" in all types of pile construction including prefabricated piles, cast-in-place piles, steel pipe piles, and the like, in foundation work, and refers to the center of the casing and excavation blades used in various pile extraction and obstacle removal work, and the like. In contrast, the hall wall direction refers to the outer circumference direction side of the pile in all types of pile construction including prefabricated piles, cast-in-place piles, steel pipe piles, and the like, in foundation work, and refers to the outer circumference direction side of the casing and excavation blades used in various pile extraction and obstacle removal work, and the like, in other words, the hole wall of the underground hole constructed by excavating the ground or obstacles.

The base portion 4 has a mountain-shaped portion in which two apex portions of the respective top and bottom of the base portion 4 protrude in the excavation direction, in other words, toward the front end side of the twin bit 1. In addition, carbide tips 7 and 8 are arranged on the two mountain-shaped portions on the respective top and bottom portions at the front end of the base portion 4.

More specifically, the carbide tip 7 comprises an inclined portion 7*a* and an inclined portion 7*b* at the top portion of the front end of the base portion 4. The inclined portion 7*a* rises at certain angles from a first plane portion 9 of the base portion 4 in the excavation direction, in other words, toward the apex portion. The inclined portion 7*b* rises at certain angles from a second plane portion 10 of the base portion 4 in the excavation direction, in other words, toward the apex portion. The length of the inclined portion 7*a* is shorter than the length of the inclined portion 7*b*. Thus, the apex portion is close to the first plane portion 9. On the other hand, the carbide tip 8 comprises an inclined portion 8*a* and an inclined portion 8*b* at the bottom of the front end of the base portion 4. The inclined portion 8*a* rises at certain angles from the first plane portion 9 of the base portion 4 in the excavation direction, in other words, toward the apex portion. The inclined portion 8*b* rises at certain angles from the second plane portion 10 of the base portion 4 in the excavation direction, in other words, toward the apex portion. The length of the inclined portion 8*a* is shorter than the length of the inclined portion 8*b*. Thus, the apex portion is close to the first plane portion 9.

As shown in FIG. 1 (*c*), the apex portion where the inclined portions 7*a* and 7*b* of the carbide tip 7 are continuous and the apex portion where the inclined portions 8*a* and 8*b* of the carbide tip 8 are continuous form edges for excavation at the respective top and bottom of the base portion 4. In addition, at the front end of the base portion 4, a recess portion 11 is formed between the carbide tips 7 and 8. The recess portion 11 not only further reduces the amount of build-up excavated soil (or swarf) but also contributes to the increase in the efficiency of excavation by controlling the flow of excavated soil (or swarf) to flow upward.

The leg portions 5 and 6 extend from the base portion 4 toward the rear end side such that the leg portions 5 and 6 are parallel to each other with a predetermined gap and form a U-shape when viewed from the plane. A hole portion 12 for attaching the twin bit 1 to the casing by means of bolts and the like is provided in the leg portions 5 and 6.

On the other hand, the auxiliary bit 3 comprises a base portion 13. The rear end portion of the base portion 13 has an inclined portion 13*a*, which is inclined toward the rear in the excavation direction, in other words, toward the rear end of the twin bit 1. A carbide tip 13*b* is arranged on the inclined surface of the inclined portion 13*a*. A hole portion in communication with the hole portion 12 of the leg portions 5 and 6 is provided in the inclined portion 13*a*.

The base portion 13 has a mountain-shaped portion in which two apex portions of the respective top and bottom of the base portion 13 protrude in the excavation direction, in other words, toward the front end side of the twin bit 1. Carbide tips 14 and 15 are arranged on the two mountain-shaped portions on the respective top and bottom portions at the front end of the base portion 13.

More specifically, the carbide tip 14 comprises an inclined portion 14*a* and an inclined portion 14*b* at the top portion of the front end of the base portion 13. The inclined portion 14*a* rises at certain angles from a third plane portion 17 of the base portion 13 in the excavation direction, in other words, toward the apex portion. The inclined portion 14*b* rises at certain angles from the second plane portion 10 in the excavation direction, in other words, toward the apex portion. The length of the inclined portion 14*a* is the same as the length of the inclined portion 14*b*. Therefore, the apex portion is located in the middle of the excavation direction or hole wall direction of the auxiliary bit 3. In other words, the apex portion is located at the center of the thickness direction of the auxiliary bit 3. On the other hand, the carbide tip 15 comprises an inclined portion 15*a* and an inclined portion 15*b* at the bottom of the front end of the base portion 13. The inclined portion 15*a* rises at certain angles from the third plane portion 17 of the base portion 13 in the excavation direction, in other words, toward the apex portion. The inclined portion 15*b* rises at certain angles from the second plane portion 10 of the base portion 13 in the excavation direction, in other words, toward the apex portion. The length of the inclined portion 14*a* is the same as the length of the inclined portion 14*b*. Therefore, the apex portion is located in the middle of the excavation direction or hole wall direction of the auxiliary bit 3. In other words, the apex portion is located at the center of the thickness direction of the auxiliary bit 3.

As shown in FIG. 1 (*c*), the apex portion where the inclined portions 14*a* and 14*b* of the carbide tip 14 are continuous and the apex portion where the inclined portions 15*a* and 15*b* of the carbide tip 15 are continuous form edges for excavation at the respective top and bottom of the base portion 14. In addition, at the front end of the base portion 13, a recess portion 16 is formed between the carbide tips 14 and 15. The recess portion 16 not only further reduces the amount of build-up excavated soil (or swarf) but also contributes to the increase in the efficiency of excavation by controlling the flow of excavated soil (or swarf) to flow upward.

With respect to the material of each portion, SCM440 (chromium-molybdenum steel) and the like can be used as base materials of the base portion 4, and the leg portions 5 and 6. Further, in JIS usage classification symbols, E3 (material name MG30), E4 (material name MG40), E5 (material name MG50), E6 (material name MG60), and the like, as well as, in CIS standards, G4 (CIS material type symbol VC-40), G5 (CIS material type symbol VC-50), and the like can be used as the carbide tips 7, 8, 14, and 15. However, these are mere examples and thus do not limit the present embodiment. In addition, hard building-ups 18 are arranged on the base portions 4 and 13.

Second Embodiment

Figure 2:
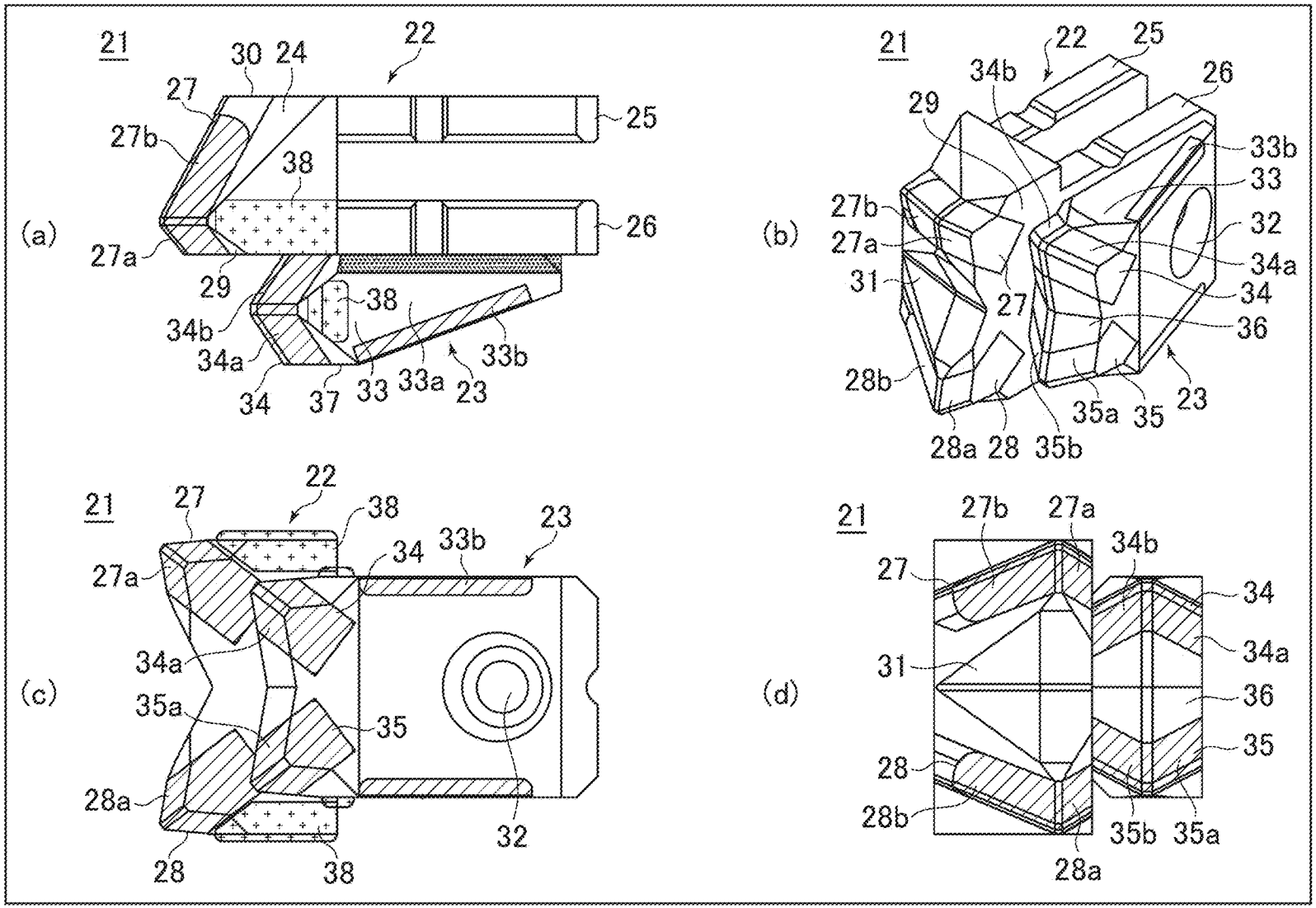
FIG. 2 is a diagram of a twin bit of a second embodiment of the present invention.

FIG. 2 (*a*) to FIG. 2 (*d*) show and explain the configuration of a twin bit of the second embodiment of the present invention. More specifically, FIG. 2 (*a*) shows a plan view of the twin bit, FIG. 2 (*b*) shows a perspective view of the twin bit, FIG. 2 (*c*) shows a side view of the twin bit, and FIG. 2 (*d*) shows a front view of the twin bit, for explanations for explanation. A main bit of the twin bit is straight-shaped and is an external-blade, and an auxiliary bit of the twin bit is a middle-blade attached to the outside. By making the auxiliary bit the middle-blade, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 2 (*a*) and FIG. 2 (*c*) alone.

As shown in these diagrams, a twin bit 21 is configured such that blade portions of front ends of a main bit 22 and an auxiliary bit 23 are staggered toward the rear in the excavation direction.

The main bit 22 is constituted by a base portion 24 and two leg portions 25 and 26 extending from the base portion 24. The base portion 24 side is hereinafter referred to as the front end of the twin bit 21 as well, and the leg portions 25 and 26 side is referred to as the attachment side to the casing or the rear end of the twin bit 21 as well. The direction which the front end faces is the excavation direction, and the direction orthogonal to the excavation direction is the hole wall direction or the pile core direction (also referred to as the thickness direction of the twin bit 21). Further, the excavation direction and the direction orthogonal to the hole wall direction or pile core direction are referred to as the width direction of the twin bit 21. The definitions of the pile core direction and the hall wall direction are the same as those described in the first embodiment.

The base portion 24 has a mountain-shaped portion in which two apex portions of the respective top and bottom of the base portion 24 protrude in the excavation direction, in other words, toward the front end side of the twin bit 21. Carbide tips 27 and 28 are arranged on the two mountain-shaped portions on the respective top and bottom portions at the front end of the base portion 24.

More specifically, the carbide tip 27 comprises an inclined portion 27*a* and an inclined portion 27*b* at the top portion of the front end of the base portion 24. The inclined portion 27*a* rises at certain angles from a first plane portion 29 of the base portion 24 in the excavation direction, in other words, toward the apex portion. The inclined portion 27*b* rises at certain angles from a second plane portion 30 of the base portion 24 in the excavation direction, in other words, toward the apex portion. The length of the inclined portion 27*a* is shorter than the length of the inclined portion 27*b*. Thus, the apex portion is closer to the first plane portion 29. On the other hand, the carbide tip 28 comprises an inclined portion 28*a* and an inclined portion 28*b* at the bottom of the front end of the base portion 24. The inclined portion 28*a* rises at certain angles from the first plane portion 29 of the base portion 24 in the excavation direction, in other words, toward the apex portion. The inclined portion 28*b* rises at certain angles from the second plane portion 30 of the base portion 24 in the excavation direction, in other words, toward the apex portion. The length of the inclined portion 28*a* is shorter than the length of the inclined portion 28*b*. Thus, the apex portion is closer to the first plane portion 29.

As shown in FIG. 2 (*c*), the apex portion where the inclined portions 27*a* and 27*b* of the carbide tip 27 are continuous and the apex portion where the inclined portions 28*a* and 28*b* of the carbide tip 28 are continuous form edges for excavation at the respective top and bottom of the base portion 24. In addition, at the front end of the base portion 24, a recess portion 31 is formed between the carbide tips 27 and 28. The recess portion 31 not only further reduces the amount of build-up excavated soil (or swarf) but also contributes to the increase in the efficiency of excavation by controlling the flow of excavated soil (or swarf) to flow upward.

The leg portions 25 and 26 extend from the base portion 24 toward the rear end side such that the leg portions 25 and 26 are parallel to each other with a predetermined gap and form a U-shape when viewed from the plane. A hole portion 32 for attaching the twin bit 21 to the casing by means of bolts and the like is provided in the leg portions 25 and 26.

On the other hand, the auxiliary bit 23 comprises a base portion 33. The rear end portion of the base portion 33 has an inclined portion 33*a*, which is inclined toward the rear in the excavation direction, in other words, toward the rear end of the twin bit 21. A carbide tip 33*b* is arranged on the inclined surface of the inclined portion 33*a*. A hole portion in communication with the hole portion 32 of the leg portions 25 and 26 is provided in the inclined portion 33*a*.

The base portion 33 has a mountain-shaped portion in which two apex portions of the respective top and bottom of the base portion 33 protrude in the excavation direction, in other words, toward the front end side of the twin bit 21. Carbide tips 34 and 35 are arranged on the two mountain-shaped portions on the respective top and bottom portions at the front end of the base portion 33.

More specifically, the carbide tip 34 comprises an inclined portion 34*a* and an inclined portion 34*b* at the top portion of the front end of the base portion 33. The inclined portion 34*a* rises at certain angles from a third plane portion 37 of the base portion 33 in the excavation direction, in other words, toward the apex portion. The inclined portion 34*b* rises at certain angles from the first plane portion 29 in the excavation direction, in other words, toward the apex portion. The length of the inclined portion 34*a* is the same as the length of the inclined portion 34*b*. Therefore, the apex portion is located in the middle of the excavation direction or hole wall direction of the auxiliary bit 23. In other words, the apex portion is located in the middle of the thickness direction of the auxiliary bit 23. On the other hand, the carbide tip 35 comprises an inclined portion 35*a* and an inclined portion 35*b* at the bottom of the front end of the base portion 33. The inclined portion 35*a* rises at certain angles from the third plane portion 37 of the base portion 33 in the excavation direction, in other words, toward the apex portion. The inclined portion 35*b* rises at certain angles from the first plane portion 29 of the base portion 33 in the excavation direction, in other words, toward the apex portion. The length of the inclined portion 34*a* is the same as the length of the inclined portion 34*b*. Therefore, the apex portion is located at the center of the excavation direction or hole wall direction of the auxiliary bit 23. In other words, the apex portion is located in the middle of the thickness direction of the auxiliary bit 23.

As shown in FIG. 2 (*c*), the apex portion where the inclined portions 34*a* and 34*b* of the carbide tip 34 are continuous and the apex portion where the inclined portions 35*a* and 35*b* of the carbide tip 35 are continuous form edges for excavation at the respective top and bottom of the base portion 33. In addition, at the front end of the base portion 33, a recess portion 36 is formed between the carbide tips 34 and 35. The recess portion 36 not only further reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 38 are arranged on the base portions 24 and 33.

Third Embodiment

Figure 3:
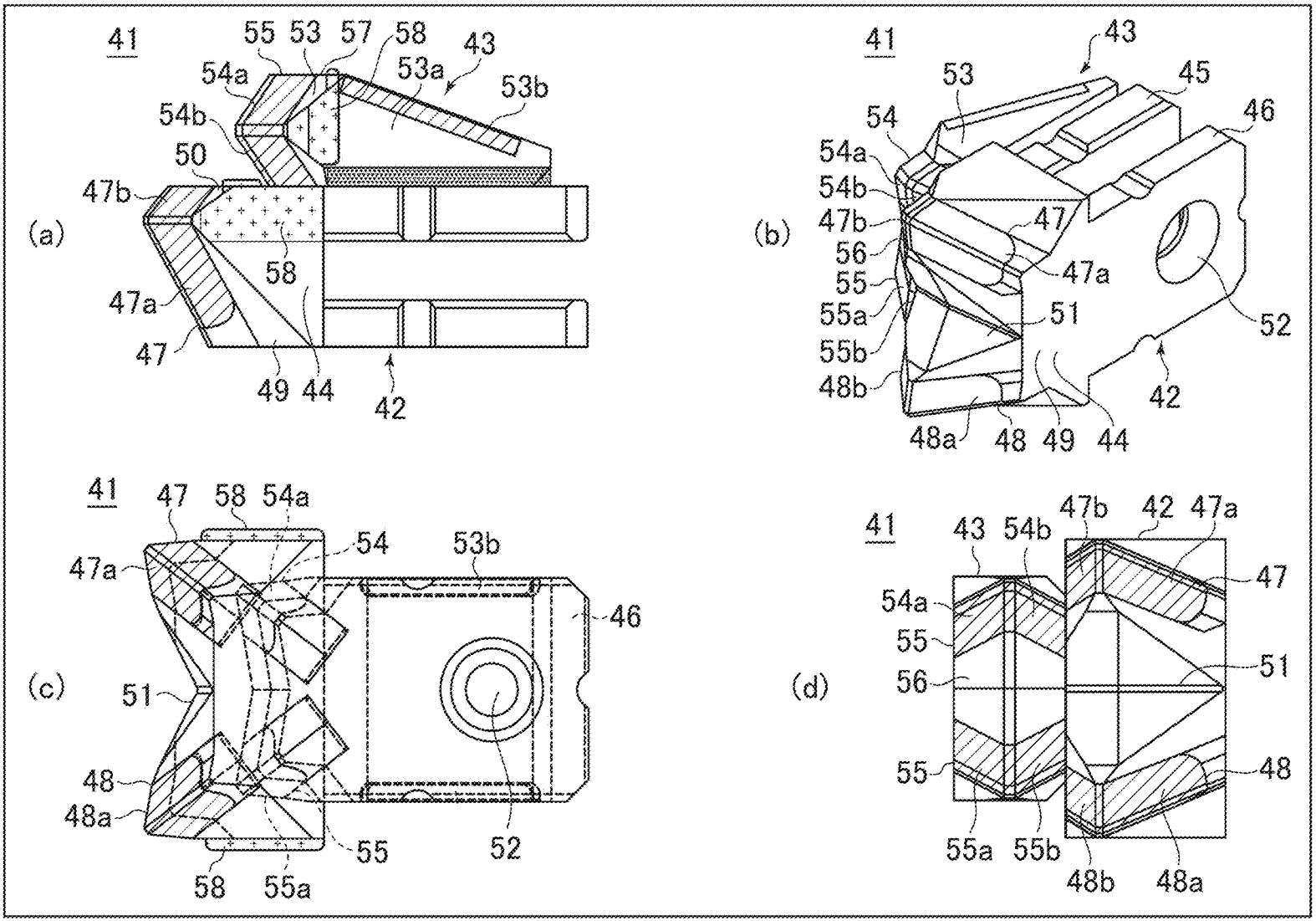
FIG. 3 is a diagram of a twin bit of a third embodiment of the present invention.

FIG. 3 (*a*) to FIG. 3 (*d*) show and explain the configuration of a twin bit of the third embodiment of the present invention. More specifically, FIG. 3 (*a*) shows a plan view of the twin bit, FIG. 3 (*b*) shows a perspective view of the twin bit, FIG. 3 (*c*) shows a side view of the twin bit, and FIG. 3 (*d*) shows a front view of the twin bit, for explanations. A main bit of the twin bit is straight-shaped and is an inner-blade, and an auxiliary bit of the twin bit is a middle-blade attached to the inside. By making the auxiliary bit the middle-blade, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 3 (*a*) and FIG. 3 (*c*) alone.

As shown in these diagrams, a twin bit 41 is configured such that blade portions of the front ends of a main bit 42 and an auxiliary bit 43 are staggered toward the rear in the excavation direction.

The main bit 42 is constituted by a base portion 44 and two leg portions 45 and 46 extending from the base portion 44. The base portion 44 side is hereinafter referred to as the front end of the twin bit 41 as well, and the leg portions 45 and 46 side is referred to as the attachment side to the casing or the rear end of the twin bit 41 as well. The direction which the front end faces is the excavation direction, and the direction orthogonal to the excavation direction is a hole wall direction or a pile core direction (also referred to as the thickness direction of the twin bit 41). Further, the excavation direction and the direction orthogonal to the hole wall direction or pile core direction are referred to as the width direction of the twin bit 41. The definitions of the pile core direction and the hall wall direction are the same as those described in the first embodiment.

The base portion 44 has a mountain-shaped portion in which two apex portions of the respective top and bottom of the base portion 44 protrude in the excavation direction, in other words, toward the front end side of the twin bit 41. Carbide tips 47 and 48 are arranged on the two mountain-shaped portions on the respective top and bottom portions at the front end of the base portion 44.

More specifically, the carbide tip 47 comprises an inclined portion 47*a* and an inclined portion 47*b* at the top portion of the front end of the base portion 44. The inclined portion 47*a* rises at certain angles from a first plane portion 49 of the base portion 44 in the excavation direction, in other words, toward the apex portion. The inclined portion 47*b* rises at certain angles from a second plane portion 50 of the base portion 44 in the excavation direction, in other words, toward the apex portion. The length of the inclined portion 47*a* is longer than the length of the inclined portion 7*b*. Thus, the apex portion is close to the second plane portion 50. On the other hand, the carbide tip 48 comprises an inclined portion 48*a* and an inclined portion 48*b* at the bottom of the front end of the base portion 44. The inclined portion 48*a* rises at certain angles from the first plane portion 49 of the base portion 44 in the excavation direction, in other words, toward the apex portion. The inclined portion 48*b* rises at certain angles from the second plane portion 50 of the base portion 44 in the excavation direction, in other words, toward the apex portion. The length of the inclined portion 48*a* is longer than the length of the inclined portion 48*b*. Thus, the apex portion is close to the second plane portion 50.

As shown in FIG. 3 (*c*), the apex portion where the inclined portions 47*a* and 47*b* of the carbide tip 47 are continuous and the apex portion where the inclined portions 48*a* and 48*b* of the carbide tip 48 are continuous form edges for excavation at the respective top and bottom of the base portion 44. In addition, at the front end of the base portion 44, a recess portion 51 is formed between the carbide tips 47 and 48. The recess portion 51 not only further reduces the amount of build-up excavated soil (or swarf) but also contributes to the increase in the efficiency of excavation by controlling the flow of excavated soil (or swarf) to flow upward.

The leg portions 45 and 46 extend from the base portion 44 toward the rear end side such that the leg portions 45 and 46 are parallel to each other with a predetermined gap and form a U-shape when viewed from the plane. A hole portion 52 for attaching the twin bit 41 to the casing by means of bolts and the like is provided in the leg portions 45 and 46.

On the other hand, the auxiliary bit 43 comprises a base portion 53. The rear end portion of the base portion 53 has an inclined portion 53*a*, which is inclined toward the rear in the excavation direction, in other words, toward the rear end of the twin bit 41. A carbide tip 53*b* is arranged on the inclined surface of the inclined portion 53*a*. A hole portion in communication with the hole portion 52 of the leg portions 45 and 46 is provided in the inclined portion 53*a*.

The base portion 53 has a mountain-shaped portion in which two apex portions of the respective top and bottom of the base portion 53 protrude in the excavation direction, in other words, toward the front end side of the twin bit 41. In addition, carbide tips 54 and 55 are arranged on the two mountain-shaped portions on the respective top and bottom portions at the front end of the base portion 53.

More specifically, the carbide tip 54 comprises an inclined portion 54*a* and an inclined portion 54*b* at the top portion of the front end of the base portion 53. The inclined portion 54*a* rises at certain angles from a third plane portion 57 of the base portion 53 in the excavation direction, in other words, toward the apex portion. The inclined portion 54*b* rises at certain angles from the second plane portion 50 in the excavation direction, in other words, toward the apex portion. The length of the inclined portion 54*a* is the same as the length of the inclined portion 54*b*. Therefore, the apex portion is located at the center of the excavation direction or hole wall direction of the auxiliary bit 43. In other words, the apex portion is located in the middle of the thickness direction of an auxiliary bit 431. On the other hand, the carbide tip 55 comprises an inclined portion 55*a* and an inclined portion 55*b* at the bottom of the front end of the base portion 53. The inclined portion 55*a* rises at certain angles from the third plane portion 57 of the base portion 53 in the excavation direction, in other words, toward the apex portion. The inclined portion 55*b* rises at certain angles from the second plane portion 50 of the base portion 53 in the excavation direction, in other words, toward the apex portion. The length of the inclined portion 54*a* is the same as the length of the inclined portion 54*b*. Therefore, the apex portion is located at the center of the excavation direction or hole wall direction of the auxiliary bit 43. In other words, the apex portion is located in the middle of the thickness direction of the auxiliary bit 43.

As shown in FIG. 3 (*c*), the apex portion where the inclined portions 54*a* and 54*b* of the carbide tip 54 are continuous and the apex portion where the inclined portions 55*a* and 55*b* of the carbide tip 55 are continuous form edges for excavation at the respective top and bottom of the base portion 53. In addition, at the front end of the base portion 53, a recess portion 56 is formed between the carbide tips 54 and 55. The recess portion 56 not only further reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 58 are provided on the base portions 44 and 53.

Fourth Embodiment

Figure 4:
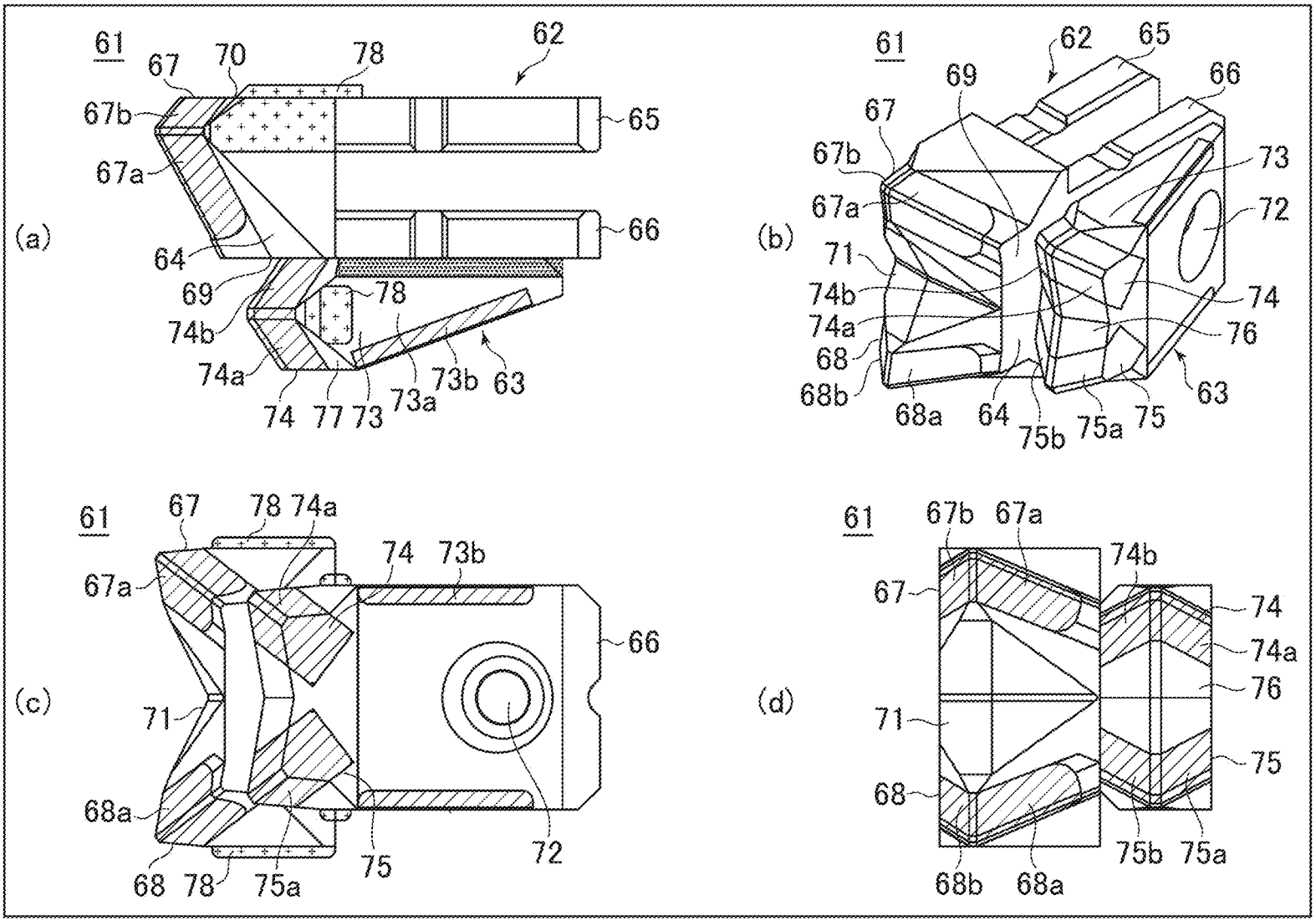
FIG. 4 is a diagram of a twin bit of a fourth embodiment of the present invention.

FIG. 4 (*a*) to FIG. 4 (*d*) show and explain the configuration of a twin bit of the fourth embodiment of the present invention. More specifically, FIG. 4 (*a*) shows a plan view of the twin bit, FIG. 4 (*b*) shows a perspective view of the twin bit, FIG. 4 (*c*) shows a side view of the twin bit, and FIG. 4 (*d*) shows a front view of the twin bit, for explanations. A main bit of the twin bit is straight-shaped and is an inner-blade, and an auxiliary bit of the twin bit is a middle-blade attached to the outside. By making the auxiliary bit the middle-blade, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 4 (*a*) alone.

As shown in these diagrams, a twin bit 61 is configured such that blade portions of the front ends of a main bit 62 and an auxiliary bit 63 are staggered toward the rear in the excavation direction.

The main bit 62 is constituted by a base portion 64 and two leg portions 65 and 66 extending from the base portion 64. The base portion 64 side is hereinafter referred to as the front end of the twin bit 61 as well, and the leg portions 65 and 66 side is referred to as the attachment side to the casing or the rear end of the twin bit 61 as well. The direction which the front end faces is the excavation direction, and the direction orthogonal to the excavation direction is a hole wall direction or a pile core direction (also referred to as the thickness direction of the twin bit 61). Further, the excavation direction and the direction orthogonal to the hole wall direction or pile core direction are referred to as the width direction of the twin bit 61. The definitions of the pile core direction and the hall wall direction are the same as those described in the first embodiment.

The base portion 64 has a mountain-shaped portion in which two apex portions of the respective top and bottom of the base portion 64 protrude in the excavation direction, in other words, toward the front end side of the twin bit 61. Carbide tips 67 and 68 are arranged on the two mountain-shaped portions on the respective top and bottom portions at the front end of the base portion 64.

More specifically, the carbide tip 67 comprises an inclined portion 67*a* and an inclined portion 67*b* at the top portion of the front end of the base portion 64. The inclined portion 67*a* rises at certain angles from a first plane portion 69 of the base portion 64 in the excavation direction, in other words, toward the apex portion. The inclined portion 67*b* rises at certain angles from a second plane portion 70 of the base portion 64 in the excavation direction, in other words, toward the apex portion. The length of the inclined portion 67*a* is longer than the length of the inclined portion 67*b*. Thus, the apex portion is close to the second plane portion 70. On the other hand, the carbide tip 68 comprises an inclined portion 68*a* and an inclined portion 68*b* at the bottom of the front end of the base portion 64. The inclined portion 68*a* rises at certain angles from the first plane portion 69 of the base portion 64 in the excavation direction, in other words, toward the apex portion. The inclined portion 68*b* rises at certain angles from the second plane portion 70 of the base portion 64 in the excavation direction, in other words, toward the apex portion. The length of the inclined portion 68*a* is longer than the length of the inclined portion 68*b*. Thus, the apex portion is close to the second plane portion 70.

As shown in FIG. 4 (*c*), the apex portion where the inclined portions 67*a* and 67*b* of the carbide tip 67 are continuous and the apex portion where the inclined portions 68*a* and 68*b* of the carbide tip 68 are continuous form edges for excavation at the respective top and bottom of the base portion 64. In addition, at the front end of the base portion 64, a recess portion 71 is formed between the carbide tips 67 and 68. The recess portion 71 not only further reduces the amount of build-up excavated soil (or swarf) but also contributes to the increase in the efficiency of excavation by controlling the flow of excavated soil (or swarf) to flow upward.

The leg portions 65 and 66 extend from the base portion 64 toward the rear end side such that the leg portions 65 and 66 are parallel to each other with a predetermined gap and form a U-shape when viewed from the plane. A hole portion 72 for attaching the twin bit 61 to the casing by means of bolts and the like is provided in the leg portions 65 and 66.

On the other hand, the auxiliary bit 63 comprises a base portion 73. The rear end portion of the base portion 73 comprises an inclined portion 73*a*, which is inclined toward the rear in the excavation direction, in other words, toward the rear end of the twin bit 61. A carbide tip 73*b* is arranged on the inclined surface of the inclined portion 73*a*. A hole portion in communication with the hole portion 72 of the leg portions 65 and 66 is provided in the inclined portion 73*a*.

The base portion 73 has a mountain-shaped portion in which two apex portions of the respective top and bottom of the base portion 73 protrude in the excavation direction, in other words, toward the front end side of the twin bit 61. Carbide tips 74 and 75 are arranged on the two mountain-shaped portions on the respective top and bottom portions at the front end of the base portion 73.

More specifically, the carbide tip 74 comprises an inclined portion 74*a* and an inclined portion 74*b* at the top portion of the front end of the base portion 73. The inclined portion 74*a* rises at certain angles from a third plane portion 77 of the base portion 73 in the excavation direction, in other words, toward the apex portion. The inclined portion 74*b* rises at certain angles from the first plane portion 69 in the excavation direction, in other words, toward the apex portion. The length of the inclined portion 74*a* is the same as the length of the inclined portion 74*b*. Therefore, the apex portion is located at the center of the excavation direction or hole wall direction of the auxiliary bit 63. In other words, the apex portion is located in the middle of the thickness direction of an auxiliary bit 63. On the other hand, the carbide tip 75 comprises an inclined portion 75*a* and an inclined portion 75*b* at the bottom of the front end of the base portion 73. The inclined portion 75*a* rises at certain angles from the third plane portion 77 of the base portion 73 in the excavation direction, in other words, toward the apex portion. The inclined portion 75*b* rises at certain angles from the first plane portion 69 of the base portion 73 in the excavation direction, in other words, toward the apex portion. The length of the inclined portion 74*a* is the same as the length of the inclined portion 74*b*. Therefore, the apex portion is located at the center of the excavation direction or hole wall direction of the auxiliary bit 63. In other words, the apex portion is located in the middle of the thickness direction of an auxiliary bit 63.

As shown in FIG. 4 (*c*), the apex portion where the inclined portions 74*a* and 74*b* of the carbide tip 74 are continuous and the apex portion where the inclined portions 75*a* and 75*b* of the carbide tip 75 are continuous form edges for excavation at the respective top and bottom of the base portion 73. In addition, at the front end of the base portion 73, a recess portion 76 is formed between the carbide tips 74 and 75. The recess portion 76 not only further reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 78 are provided on the base portions 64 and 73.

Fifth Embodiment

Figure 5:
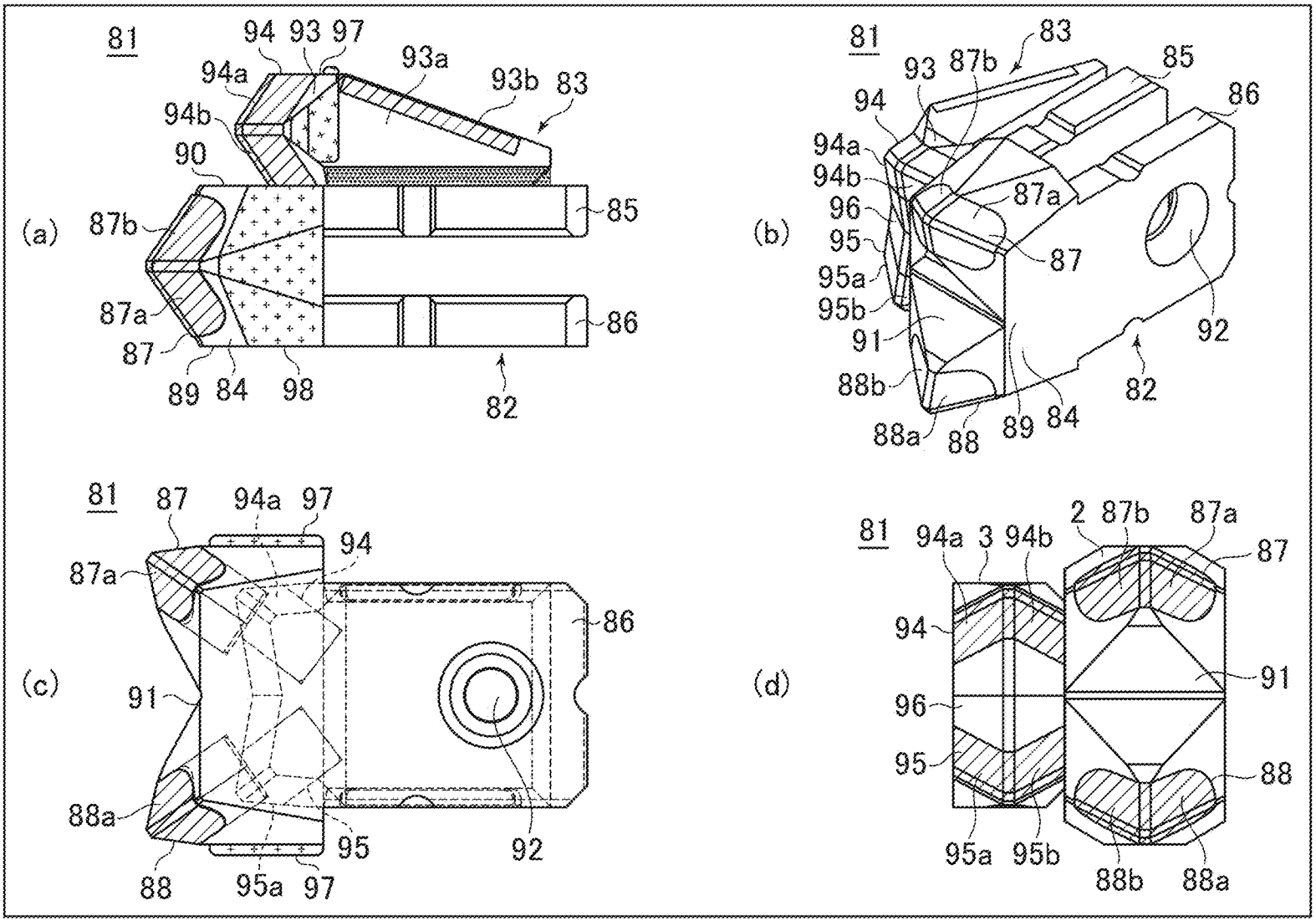
FIG. 5 is a diagram of a twin bit of a fifth embodiment of the present invention.

FIG. 5 (*a*) to FIG. 5 (*d*) show and explain the configuration of a twin bit of the fifth embodiment of the present invention. More specifically, FIG. 5 (*a*) shows a plan view of the twin bit, FIG. 5 (*b*) shows a perspective view of the twin bit, FIG. 5 (*c*) shows a side view of the twin bit, and FIG. 5 (*d*) shows a front view of the twin bit, for explanations. A main bit of the twin bit is straight-shaped and is a middle-blade, and an auxiliary bit of the twin bit is a middle-blade attached to the inside. By using the main bit and the auxiliary bit as the middle-blades, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 5 (*a*) and FIG. 5 (*c*) alone.

As shown in these diagrams, a twin bit 81 is configured such that blade portions of the front ends of a main bit 82 and an auxiliary bit 83 are staggered toward the rear in the excavation direction.

The main bit 82 is constituted by a base portion 84 and two leg portions 85 and 86 extending from the base portion 84. The base portion 84 side is hereinafter referred to as the front end of the twin bit 81 as well, and the leg portions 85 and 86 side is referred to as the attachment side to the casing or the rear end of the twin bit 81 as well. The direction which the front end faces is the excavation direction, and the direction orthogonal to the excavation direction is a hole wall direction or a pile core direction (also referred to as the thickness direction of the twin bit 81). Further, the excavation direction and the direction orthogonal to the hole wall direction or pile core direction are referred to as the width direction of the twin bit 81. The definitions of the pile core direction and the hall wall direction are the same as those described in the first embodiment.

The base portion 84 has a mountain-shaped portion in which two apex portions of the respective top and bottom of the base portion 84 protrude in the excavation direction, in other words, toward the front end side of the twin bit 81. Carbide tips 87 and 88 are arranged on the two mountain-shaped portions on the respective top and bottom portions at the front end of the base portion 84.

More specifically, the carbide tip 87 comprises an inclined portion 87*a* and an inclined portion 87*b* at the top portion of the front end of the base portion 84. The inclined portion 87*a* rises at certain angles from a first plane portion 89 of the base portion 84 in the excavation direction, in other words, toward the apex portion. The inclined portion 87*b* rises at certain angles from a second plane portion 90 of the base portion 84 in the excavation direction, in other words, toward the apex portion. The length of the inclined portion

87*a* is the same as the length of the inclined portion 87*b*. The apex portion is located at the center between the first plane portion 89 and the second plane portion 90. In other words, the apex portion is located in the middle of the thickness direction of the twin bit 81. On the other hand, the carbide tip 88 comprises an inclined portion 88*a* and an inclined portion 88*b* at the bottom of the front end of the base portion 84. The inclined portion 88*a* rises at certain angles from the first plane portion 89 of the base portion 84 in the excavation direction, in other words, toward the apex portion. The inclined portion 88*b* rises at certain angles from the second plane portion 90 of the base portion 84 in the excavation direction, in other words, toward the apex portion. The length of the inclined portion 88*a* is the same as the length of the inclined portion 88*b*. The apex portion is located at the center between the first plane portion 89 and the second plane portion 90. In other words, the apex portion is located in the middle of the thickness direction of the twin bit 81.

As shown in FIG. 5 (*c*), the apex portion where the inclined portions 87*a* and 87*b* of the carbide tip 87 are continuous and the apex portion where the inclined portions 88*a* and 88*b* of the carbide tip 88 are continuous form edges for excavation at the respective top and bottom of the base portion 84. In addition, at the front end of the base portion 84, a recess portion 91 is formed between the carbide tips 87 and 88. The recess portion 91 not only further reduces the amount of build-up excavated soil (or swarf) but also contributes to the increase in the efficiency of excavation by controlling the flow of excavated soil (or swarf) to flow upward.

The leg portions 85 and 86 extend from the base portion 84 toward the rear end side such that the leg portions 85 and 86 are parallel to each other with a predetermined gap and form a U-shape when viewed from the plane. A hole portion 92 for attaching the twin bit 81 to the casing by means of bolts and the like is provided in the leg portions 85 and 86.

On the other hand, the auxiliary bit 83 comprises a base portion 93. The rear end portion of the base portion 93 has an inclined portion 93*a*, which is inclined toward the rear in the excavation direction, in other words, toward the rear end of the twin bit 81. A carbide tip 93*b* is arranged on the inclined surface of the inclined portion 93*a*. A hole portion in communication with the hole portion 92 of the leg portions 85 and 86 is provided in the inclined portion 93*a*.

The base portion 93 has a mountain-shaped portion in which two apex portions of the respective top and bottom of the base portion 93 protrude in the excavation direction, in other words, toward the front end side of the twin bit 81. Carbide tips 94 and 95 are arranged on the two mountain-shaped portions on the respective top and bottom portions at the front end of the base portion 93.

More specifically, the carbide tip 94 comprises an inclined portion 94*a* and an inclined portion 94*b* at the top portion of the front end of the base portion 93. The inclined portion 94*a* rises at certain angles from a third plane portion 97 of the base portion 93 in the excavation direction, in other words, toward the apex portion. The inclined portion 94*b* rises at certain angles from the second plane portion 90 in the excavation direction, in other words, toward the apex portion. The length of the inclined portion 94*a* is the same as the length of the inclined portion 94*b*. Therefore, the apex portion is located at the center of the excavation direction or hole wall direction of the auxiliary bit 83. In other words, the apex portion is located in the middle of the thickness direction of the twin bit 81. On the other hand, the carbide tip 95 comprises an inclined portion 95*a* and an inclined portion 95*b* at the bottom of the front end of the base portion 93. The inclined portion 95*a* rises at certain angles from the third plane portion 97 of the base portion 93 in the excavation direction, in other words, toward the apex portion. The inclined portion 95*b* rises at certain angles from the second plane portion 90 of the base portion 93 in the excavation direction, in other words, toward the apex portion. The length of the inclined portion 95*a* is the same as the length of the inclined portion 95*b*. Therefore, the apex portion is located at the center of the excavation direction or hole wall direction of the auxiliary bit 83. In other words, the apex portion is located in the middle of the thickness direction of the twin bit 81.

As shown in FIG. 5 (*c*), the apex portion where the inclined portions 94*a* and 94*b* of the carbide tip 94 are continuous and the apex portion where the inclined portions 95*a* and 95*b* of the carbide tip 95 are continuous form edges for excavation at the respective top and bottom of the base portion 93. In addition, at the front end of the base portion 93, a recess portion 96 is formed between the carbide tips 94 and 95. The recess portion 96 not only further reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 98 are provided on the base portions 84 and 93.

Sixth Embodiment

Figure 6:
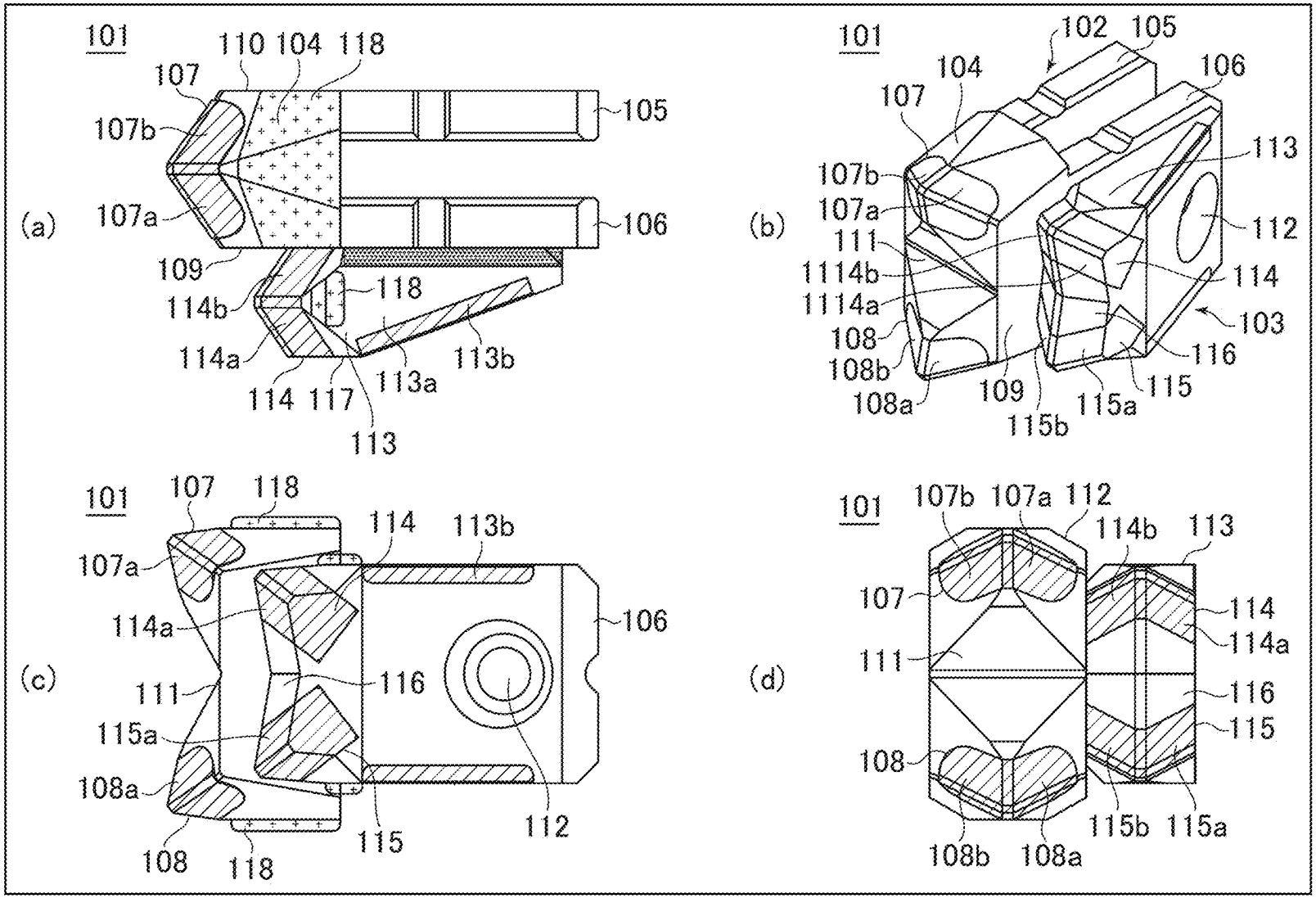
FIG. 6 is a diagram of a twin bit of a sixth embodiment of the present invention.

FIG. 6 (*a*) to FIG. 6 (*d*) show and explain the configuration of a twin bit of the sixth embodiment of the present invention. More specifically, FIG. 6 (*a*) shows a plan view of the twin bit, FIG. 6 (*b*) shows a perspective view of the twin bit, FIG. 6 (*c*) shows a side view of the twin bit, and FIG. 6 (*d*) shows a front view of the twin bit, for explanations. A main bit of the twin bit is straight-shaped and is a middle-blade, and an auxiliary bit of the twin bit is a middle-blade attached to the outside. By using the main bit and the auxiliary bit as the middle-blades, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 6 (*a*) and FIG. 6 (*c*) alone.

As shown in these diagrams, a twin bit 101 is configured such that blade portions of the front ends of a main bit 102 and an auxiliary bit 103 are staggered toward the rear in the excavation direction.

The main bit 102 is constituted by a base portion 104 and two leg portions 105 and 106 extending from the base portion 104. The base portion 104 side is hereinafter referred to as the front end of the twin bit 101 as well, and the leg portions 105 and 106 side is referred to as the attachment side to the casing or the rear end of the twin bit 101 as well. The direction which the front end faces is the excavation direction, and the direction orthogonal to the excavation direction is the hole wall direction or the pile core direction (also referred to as the thickness direction of the twin bit 101). Further, the excavation direction and the direction orthogonal to the hole wall direction or pile core direction are referred to as the width direction of the twin bit 101. The definitions of the pile core direction and the hall wall direction are the same as those described in the first embodiment.

The base portion 104 has a mountain-shaped portion in which two apex portions of the respective top and bottom of the base portion 104 protrude in the excavation direction, in other words, toward the front end side of the twin bit 101. Carbide tips 107 and 108 are arranged on the two mountain-shaped portions on the respective top and bottom portions at the front end of the base portion 104.

More specifically, the carbide tip 107 comprises an inclined portion 107*a* and an inclined portion 107*b* at the top portion of the front end of the base portion 104. The inclined portion 107*a* rises at certain angles from a first plane portion 109 of the base portion 104 in the excavation direction, in other words, toward the apex portion. The inclined portion 107*b* rises at certain angles from a second plane portion 110 of the base portion 102 in the excavation direction, in other words, toward the apex portion. The length of the inclined portion 107*a* is the same as the length of the inclined portion 107*b*. The apex portion is located at the center between the first plane portion 109 and the second plane portion 110. In other words, the apex portion is located in the middle of the thickness direction of the main bit 102. On the other hand, the carbide tip 108 comprises an inclined portion 108*a* and an inclined portion 108*b* at the bottom of the front end of the base portion 104. The inclined portion 108*a* rises at certain angles from the first plane portion 109 of the base portion 104 in the excavation direction, in other words, toward the apex portion. The inclined portion 108*b* rises at certain angles from the second plane portion 110 of the base portion 104 in the excavation direction, in other words, toward the apex portion. The length of the inclined portion 108*a* is the same as the length of the inclined portion 108*b*. The apex portion is located at the center between the first plane portion 109 and the second plane portion 110. In other words, the apex portion is located in the middle of the thickness direction of the main bit 102.

As shown in FIG. 6 (*c*), the apex portion where the inclined portions 107*a* and 107*b* of the carbide tip 107 are continuous and the apex portion where the inclined portions 108*a* and 108*b* of the carbide tip 108 are continuous form edges for excavation at the respective top and bottom of the base portion 104. In addition, at the front end of the base portion 104, a recess portion 111 is formed between the carbide tips 107 and 108. The recess portion 111 not only further reduces the amount of build-up excavated soil (or swarf) but also contributes to the increase in the efficiency of excavation by controlling the flow of excavated soil (or swarf) to flow upward.

The leg portions 105 and 106 extend from the base portion 104 toward the rear end side such that the leg portions 105 and 106 are parallel to each other with a predetermined gap and form a U-shape when viewed from the plane. A hole portion 112 for attaching the twin bit 101 to the casing by means of bolts and the like is provided in the leg portions 105 and 106.

On the other hand, the auxiliary bit 103 comprises a base portion 113. The rear end portion of the base portion 113 has an inclined portion 113*a*, which is inclined toward the rear in the excavation direction, in other words, toward the rear end of the twin bit 101. A carbide tip 113*b* is arranged on the inclined surface of the inclined portion 113*a*. A hole portion in communication with the hole portion 112 of the leg portions 105 and 106 is provided in the inclined portion 113*a*.

The base portion 113 has a mountain-shaped portion in which two apex portions of the respective top and bottom of the base portion 113 protrude in the excavation direction, in other words, toward the front end side of the twin bit 101. Carbide tips 114 and 115 are arranged on the two mountain-shaped portions on the respective top and bottom portions at the front end of the base portion 113.

More specifically, the carbide tip 114 comprises an inclined portion 114*a* and an inclined portion 114*b* at the top portion of the front end of the base portion 113. The inclined portion 114*a* rises at certain angles from a third plane portion 117 of the base portion 113 in the excavation direction, in other words, toward the apex portion. The inclined portion 114*b* rises at certain angles from the first plane portion 109 in the excavation direction, in other words, toward the apex portion. The length of the inclined portion 114*a* is the same as the length of the inclined portion 114*b*. Therefore, the apex portion is located at the center of the excavation direction or hole wall direction of the auxiliary bit 103. In other words, the apex portion is located in the middle of the thickness direction of the auxiliary bit 103. On the other hand, the carbide tip 115 comprises an inclined portion 115*a* and an inclined portion 115*b* at the bottom of the front end of the base portion 113. The inclined portion 115*a* rises at certain angles from the third plane portion 117 of the base portion 113 in the excavation direction, in other words, toward the apex portion. The inclined portion 115*b* rises at certain angles from the first plane portion 109 of the base portion 113 in the excavation direction, in other words, toward the apex portion. The length of the inclined portion 114*a* is the same as the length of the inclined portion 114*b*. Therefore, the apex portion is located at the center of the excavation direction or hole wall direction of the auxiliary bit 103. In other words, the apex portion is located in the middle of the thickness direction of the auxiliary bit 103.

As shown in FIG. 6 (*c*), the apex portion where the inclined portions 114*a* and 114*b* of the carbide tip 114 are continuous and the apex portion where the inclined portions 115*a* and 115*b* of the carbide tip 115 are continuous form edges for excavation at the respective top and bottom of the base portion 113. In addition, at the front end of the base portion 113, a recess portion 116 is formed between the carbide tips 114 and 115. This recess portion 116 not only reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 118 are provided on the base portions 104 and 113.

Seventh Embodiment

Figure 7:
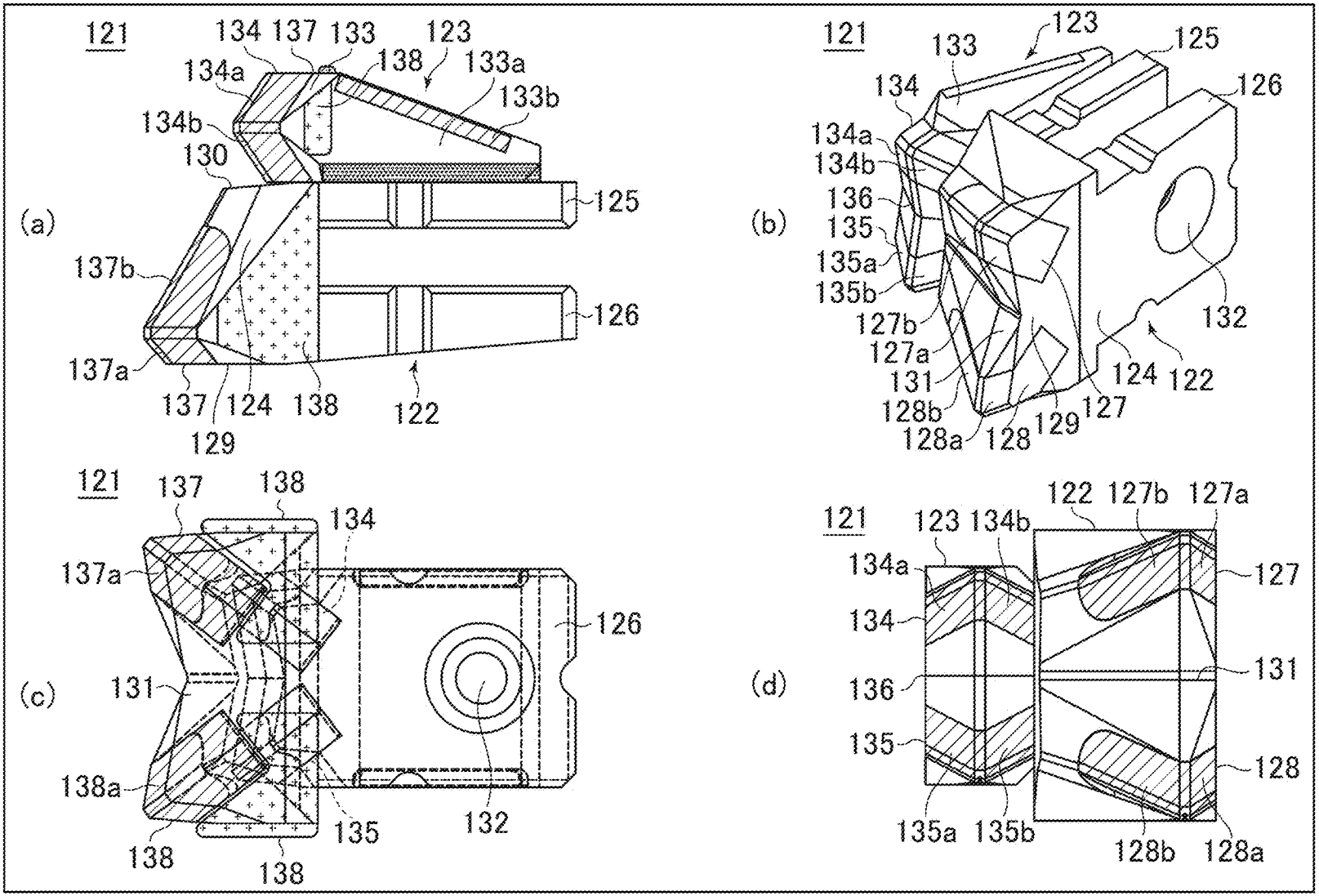
FIG. 7 is a diagram of a twin bit of a seventh embodiment of the present invention.

FIG. 7 (*a*) to FIG. 7 (*d*) show and explain the configuration of a twin bit of the seventh embodiment of the present invention. More specifically, FIG. 7 (*a*) shows a plan view of the twin bit, FIG. 7 (*b*) shows a perspective view of the twin bit, FIG. 7 (*c*) shows a side view of the twin bit, and FIG. 7 (*d*) shows a front view of the twin bit, for explanations. A main bit of the twin bit is angled and is an external-blade, and an auxiliary bit of the twin bit is a middle-blade attached to the inside. By making the auxiliary bit the middle-blade, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 7 (*a*) alone.

As shown in these diagrams, a twin bit 121 is configured such that blade portions of the front ends of a main bit 122 and an auxiliary bit 123 are staggered toward the rear in the excavation direction.

The main bit 122 is constituted by a base portion 124 and two leg portions 125 and 126 extending from the base portion 124. The base portion 124 side is hereinafter referred to as the front end of the twin bit 121 as well, and the leg portions 125 and 126 side is referred to as the attachment side to the casing or the rear end of the twin bit 121 as well. The direction which the front end faces is the excavation direction, and the direction orthogonal to the excavation direction is the hole wall direction or the pile core direction (also referred to as the thickness direction of the twin bit 121). Further, the excavation direction and the direction orthogonal to the hole wall direction or pile core direction are referred to as the width direction of the twin bit 121. The definitions of the pile core direction and the hall wall direction are the same as those described in the first embodiment.

The base portion 124 has a mountain-shaped portion in which two apex portions of the respective top and bottom of the base portion 124 protrude in the excavation direction, in other words, toward the front end side of the twin bit 121. Carbide tips 127 and 128 are arranged on the two mountain-shaped portions on the respective top and bottom portions at the front end of the base portion 124.

More specifically, the carbide tip 127 comprises an inclined portion 127*a* and an inclined portion 127*b* at the top portion of the front end of the base portion 124. The inclined portion 127*a* rises at certain angles from a first plane portion 129 of the base portion 124 in the excavation direction, in other words, toward the apex portion. The inclined portion 127*b* rises at certain angles from a second plane portion 130 of the base portion 124 in the excavation direction, in other words, toward the apex portion. The length of the inclined portion 127*a* is shorter than the length of the inclined portion 127*b*. Thus, the apex portion is closer to the first plane portion 129. In contrast, the carbide tip 128 comprises an inclined portion 128*a* and an inclined portion 128*b* at the bottom of the front end of the base portion 124. The inclined portion 128*a* rises at certain angles from the first plane portion 129 of the base portion 124 in the excavation direction, in other words, toward the apex portion. The inclined portion 128*b* rises at certain angles from the second plane portion 130 of the base portion 124 in the excavation direction, in other words, toward the apex portion. The length of the inclined portion 128*a* is shorter than the length of the inclined portion 128*b*. Thus, the apex portion is closer to the first plane portion 129.

As shown in FIG. 7 (*c*), the apex portion where the inclined portions 127*a* and 127*b* of the carbide tip 127 are continuous and the apex portion where the inclined portions 128*a* and 128*b* of the carbide tip 128 are continuous form edges for excavation at the respective top and bottom of the base portion 124. In addition, at the front end of the base portion 124, a recess portion 131 is formed between the carbide tips 127 and 128. The recess portion 131 not only further reduces the amount of build-up excavated soil (or swarf) but also contributes to the increase in the efficiency of excavation by controlling the flow of excavated soil (or swarf) to flow upward.

The leg portions 125 and 126 extend from the base portion 124 toward the rear end side such that inside planes of these leg portions 125 and 126 are parallel to each other with a predetermined gap and form a U-shape when viewed from the plane. The present embodiment is different from the first embodiment in that the outer surface of the leg portion 126 is inclined at predetermined angles. A hole portion 132 for attaching the twin bit 121 to the casing by means of bolts and the like is provided in the leg portions 125 and 126.

On the other hand, the auxiliary bit 123 comprises a base portion 133. The rear end portion of the base portion 133 has an inclined portion 133*a*, which is inclined toward the rear in the excavation direction, in other words, toward the rear end of the twin bit 121. A carbide tip 133*b* is arranged on the inclined surface of the inclined portion 133*a*. A hole portion in communication with the hole portion 132 of the leg portions 125 and 126 is provided in the inclined portion 133*a*.

The base portion 133 has a mountain-shaped portion in which two apex portions of the respective top and bottom of the base portion 133 protrude in the excavation direction, in other words, toward the front end side of the twin bit 121. Carbide tips 134 and 135 are arranged on the two mountain-shaped portions on the respective top and bottom portions at the front end of the base portion 133.

More specifically, the carbide tip 134 comprises an inclined portion 134*a* and an inclined portion 134*b* at the top portion of the front end of the base portion 133. The inclined portion 134*a* rises at certain angles from a third plane portion 137 of the base portion 133 in the excavation direction, in other words, toward the apex portion. The inclined portion 134*b* rises at certain angles from the second plane portion 130 in the excavation direction, in other words, toward the apex portion. The length of the inclined portion 134*a* is the same as the length of the inclined portion 134*b*. Therefore, the apex portion is located at the center of the excavation direction or hole wall direction of the auxiliary bit 123. In other words, the apex portion is located in the middle of the thickness direction of an auxiliary bit 123. On the other hand, the carbide tip 135 comprises an inclined portion 135*a* and an inclined portion 135*b* at the bottom of the front end of the base portion 133. The inclined portion 135*a* rises at certain angles from the third plane portion 137 of the base portion 133 in the excavation direction, in other words, toward the apex portion. The inclined portion 135*b* rises at certain angles from the second plane portion 130 of the base portion 133 in the excavation direction, in other words, toward the apex portion. The length of the inclined portion 135*a* is the same as the length of the inclined portion 135*b*. Therefore, the apex portion is located at the center of the excavation direction or hole wall direction of the auxiliary bit 123. In other words, the apex portion is located in the middle of the thickness direction of the auxiliary bit 123.

As shown in FIG. 7 (*c*), the apex portion where the inclined portions 134*a* and 134*b* of the carbide tip 134 are continuous and the apex portion where the inclined portions 135*a* and 135*b* of the carbide tip 135 are continuous form edges for excavation at the respective top and bottom of the base portion 133. In addition, at the front end of the base portion 133, a recess portion 136 is formed between the carbide tips 134 and 135. The recess portion 136 not only further reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 138 are provided on the base portions 124 and 133.

Eighth Embodiment

Figure 8:
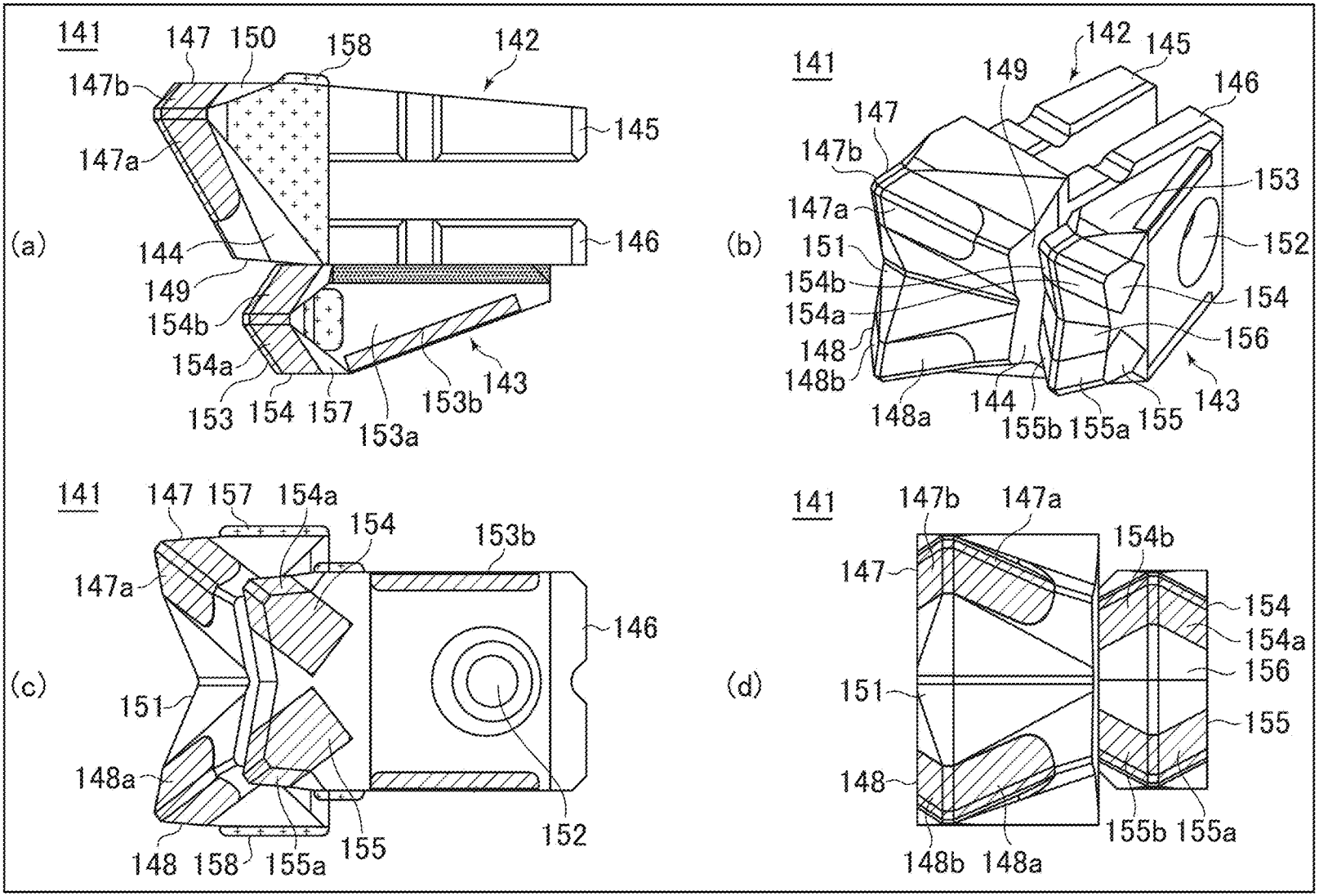
FIG. 8 is a diagram of a twin bit of an eighth embodiment of the present invention.

FIG. 8 (*a*) to FIG. 8 (*d*) show and explain the configuration of a twin bit of the eighth embodiment of the present invention. More specifically, FIG. 8 (*a*) shows a plan view of the twin bit, FIG. 8 (*b*) shows a perspective view of the twin bit, FIG. 8 (*c*) shows a side view of the twin bit, and FIG. 8 (*d*) shows a front view of the twin bit, for explanations. A main bit of the twin bit is angled and is an inner-blade, and an auxiliary bit of the twin bit is a middle-blade attached to the outside. By making the auxiliary bit the middle-blade, a middle position between the cutting edge positions of the external-blade and inner-blade can be excavated, and thus not only the excavation efficiency can be increased but also scraping of the excavation target can be made easier. In order to clearly show the configuration of each portion, hard building-ups are shown in FIG. 8 (*a*) alone.

As shown in these diagrams, a twin bit 141 is integrally formed such that blade portions of the front ends of a main bit 142 and an auxiliary bit 143 are staggered toward the rear in the excavation direction.

The main bit 142 is constituted by a base portion 144 and two leg portions 145 and 146 extending from the base portion 144. The base portion 144 side is hereinafter referred to as the front end of the twin bit 141 as well, and the leg portions 145 and 146 side is referred to as the attachment side to the casing or the rear end of the twin bit 141. The direction which the front end faces is the excavation direction, and the direction orthogonal to the excavation direction is the hole wall direction or the pile core direction (also referred to as the thickness direction of the twin bit 141). Further, the excavation direction and the direction orthogonal to the hole wall direction or pile core direction are referred to as the width direction of the twin bit 141. The definitions of the pile core direction and the hall wall direction are the same as those described in the first embodiment.

The base portion 144 has a mountain-shaped portion in which two apex portions of the respective top and bottom of the base portion 144 protrude in the excavation direction, in other words, toward the front end side of the twin bit 141. Carbide tips 147 and 148 are arranged on the two mountain-shaped portions on the respective top and bottom portions at the front end of the base portion 144.

More specifically, the carbide tip 147 comprises an inclined portion 147*a* and an inclined portion 147*b* at the top portion of the front end of the base portion 144. The inclined portion 147*a* rises at certain angles from a first plane portion 149 of a base portion 1442 in the excavation direction, in other words, toward the apex portion. The inclined portion 147*b* rises at certain angles from a second plane portion 150 of the base portion 144 in the excavation direction, in other words, toward the apex portion. The length of the inclined portion 147*a* is longer than the length of the inclined portion 147*b*. Thus, the apex portion is close to the second plane portion 150. On the other hand, the carbide tip 148 comprises an inclined portion 148*a* and an inclined portion 148*b* at the bottom of the front end of the base portion 144. The inclined portion 148*a* rises at certain angles from the first plane portion 149 of the base portion 144 in the excavation direction, in other words, toward the apex portion. The inclined portion 148*b* rises at certain angles from the second plane portion 150 of the base portion 144 in the excavation direction, in other words, toward the apex portion. The length of the inclined portion 148*a* is longer than the length of the inclined portion 148*b*. Thus, the apex portion is close to the second plane portion 150.

As shown in FIG. 8 (*c*), the apex portion where the inclined portions 147*a* and 147*b* of the carbide tip 147 are continuous and the apex portion where the inclined portions 148*a* and 148*b* of the carbide tip 148 are continuous form edges for excavation at the respective top and bottom of the base portion 144. In addition, at the front end of the base portion 144, a recess portion 151 is formed between the carbide tips 147 and 148. The recess portion 151 not only further reduces the amount of build-up excavated soil (or swarf) but also contributes to the increase in the efficiency of excavation by controlling the flow of excavated soil (or swarf) to flow upward.

The leg portions 145 and 146 extend from the base portion 64 toward the rear end side such that inside planes of these leg portions 145 and 146 are parallel to each other with a predetermined gap and form a U-shape when viewed from the plane. The present embodiment is different from the fourth embodiment in that the outer surface of the leg portion 145 is inclined at predetermined angles. A hole portion 152 for attaching the twin bit 141 to the casing by means of bolts and the like is provided in the leg portions 145 and 146.

On the other hand, the auxiliary bit 143 comprises a base portion 153. The rear end portion of the base portion 153 has an inclined portion 153*a*, which is inclined toward the rear in the excavation direction, in other words, toward the rear end of the twin bit 141. A carbide tip 153*b* is arranged on the inclined surface of the inclined portion 153*a*. A hole portion in communication with the hole portion 152 of the leg portions 145 and 146 is provided in the inclined portion 153*a*.

The base portion 153 has a mountain-shaped portion in which two apex portions of the respective top and bottom of the base portion 153 protrude in the excavation direction, in other words, toward the front end side of the twin bit 141. Carbide tips 154 and 155 are arranged on the two mountain-shaped portions on the respective top and bottom portions at the front end of the base portion 153.

More specifically, the carbide tip 154 comprises an inclined portion 154*a* and an inclined portion 144*b* at the top portion of the front end of the base portion 153. The inclined portion 154*a* rises at certain angles from a third plane portion 157 of the base portion 153 in the excavation direction, in other words, toward the apex portion. The inclined portion 144*b* rises at certain angles from the first plane portion 149 in the excavation direction, in other words, toward the apex portion. The length of the inclined portion 154*a* is the same as the length of the inclined portion 154*b*. Therefore, the apex portion is located at the center of the excavation direction or hole wall direction of the auxiliary bit 143. In other words, the apex portion is located in the middle of the thickness direction of an auxiliary bit 143. On the other hand, the carbide tip 155 comprises an inclined portion 155*a* and an inclined portion 155*b* at the bottom of the front end of the base portion 153. The inclined portion 155*a* rises at certain angles from the third plane portion 157 of the base portion 153 in the excavation direction, in other words, toward the apex portion. The inclined portion 155*b* rises at certain angles from the first plane portion 149 of the base portion 153 in the excavation direction, in other words, toward the apex portion. The length of the inclined portion 155*a* is the same as the length of the inclined portion 155*b*. Therefore, the apex portion is located at the center of the excavation direction or hole wall direction of the auxiliary bit 143. In other words, the apex portion is located in the middle of the thickness direction of an auxiliary bit 143.

As shown in FIG. 8 (*c*), the apex portion where the inclined portions 154*a* and 154*b* of the carbide tip 154 are continuous and the apex portion where the inclined portions 155*a* and 155*b* of the carbide tip 155 are continuous form edges for excavation at the respective top and bottom of the base portion 153. In addition, at the front end of the base portion 153, a recess portion 156 is formed between the carbide tips 154 and 155. The recess portion 156 not only further reduces the amount of build-up excavated soil (or swarf) but also contributes to the increase in the efficiency of excavation by controlling the flow of excavated soil (or swarf) to flow upward.

The materials used for the portions are the same as the one described in the first embodiment. Hard building-ups 158 are provided on the base portions 144 and 153.

The first to eighth embodiments describe examples in which the two carbide tips on the top and bottom of the auxiliary bit are both middle-blades. An external-blade and an inner-blade may be adopted instead of these two middle-blades.

That is, for example, in the first embodiment, the apex portion of the carbide tip 14 of the auxiliary bit 3 is located at the middle of the excavation direction or the hole wall direction of the auxiliary bit 3. In other words, the apex portion is located at the center of the thickness direction of the twin bit 1. Similarly, the apex portion of the carbide tip 15 is located in the middle of the excavation direction or hole wall direction of the auxiliary bit 3. In other words, the apex portion is located at the center of the thickness direction of the twin bit 1. This apex portion may be moved to be closer to either the excavation direction or hall wall direction and be used as an external-blade or an inner-blade.

Herein after, examples in which the auxiliary bit of the twin bit of the first embodiment of the present invention is either an inner-blade or an external-blade will be described with reference to FIG. 15 (*a*) and FIG. 15 (*d*).

Figure 15:
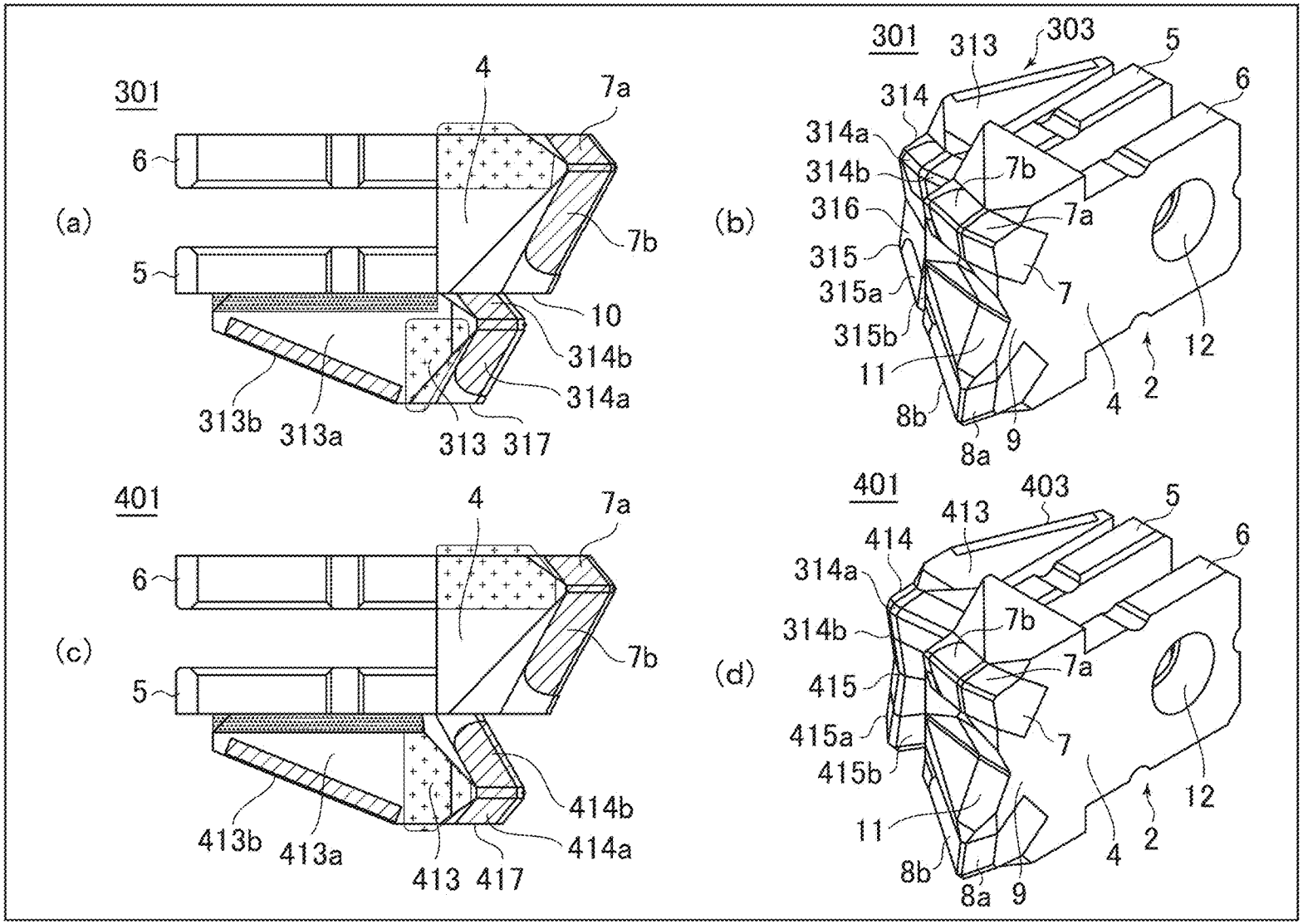
FIG. 15 is a configuration diagram showing an improved example of the twin bit of the first embodiment of the present invention.

First, FIG. 15 (*a*) and FIG. 15 (*b*) show the configuration examples when the auxiliary bit is an inner-blade. In the following descriptions, configurations substantially equivalent to those in the first embodiment are denoted by the same reference numerals as those in FIG. 1 (*a*) to FIG. 1 (*d*) and explanation on these configurations are omitted for the sake of simplifying explanations.

As shown in FIG. 15 (*a*) and FIG. 15 (*b*), an auxiliary bit 303 comprises a base portion 313. The rear end portion of the base portion 313 has an inclined portion 313*a*, which is inclined toward the rear in the excavation direction, in other words, toward the rear end of the twin bit 301. A carbide tip 313*b* is arranged on the inclined surface of the inclined portion 313*a*. A hole portion in communication with the hole portion 12 of the leg portions 5 and 6 is provided in the inclined portion 313*a*.

The base portion 313 has a mountain-shaped portion in which two apex portions of the respective top and bottom of the base portion 313 protrude in the excavation direction, in other words, toward the front end side of the twin bit 301. Carbide tips 314 and 315 are arranged on the two mountain-shaped portions on the respective top and bottom portions at the front end of the base portion 313.

More specifically, the carbide tip 314 comprises an inclined portion 314*a* and an inclined portion 314*b* at the top portion of the front end of the base portion 313. The inclined portion 314*a* rises at certain angles from a third plane portion 317 of the base portion 313 in the excavation direction, in other words, toward the apex portion. The inclined portion 314*b* rises at certain angles from the second plane portion 10 of the base portion 313 in the excavation direction, in other words, toward the apex portion. The length of the inclined portion 314*a* is longer than the length of the inclined portion 314*b*. Thus, the apex portion is close to the second plane portion 10 of the auxiliary bit 303. In other words, the apex portion is located close to the main bit 302 in the thickness direction of the auxiliary bit 303. On the other hand, the carbide tip 315 comprises an inclined portion 315*a* and an inclined portion 315*b* at the bottom of the front end of the base portion 313. The inclined portion 315*a* rises at certain angles from the third plane portion 317 of the base portion 313 in the excavation direction, in other words, toward the apex portion. The inclined portion 315*b* rises at certain angles from the second plane portion 10 of the base portion 313 in the excavation direction, in other words, toward the apex portion. The length of the inclined portion 315*a* is longer than the length of the inclined portion 315*b*. Thus, the apex portion is close to the second plane portion 10 of the auxiliary bit 303 in the excavation direction or the hole wall direction. In other words, the apex portion is located close to the main bit 302 in the thickness direction of the auxiliary bit 303.

The apex portion where the inclined portions 314*a* and 314*b* of the carbide tip 314 are continuous and the apex portion where the inclined portions 315*a* and 315*b* of the carbide tip 315 are continuous form edges for excavation at the respective top and bottom of the base portion 314. In addition, at the front end of the base portion 313, a recess portion 316 is formed between the carbide tips 314 and 315. The recess portion 316 not only further reduces the amount of build-up excavated soil (or swarf) but also contributes to the increase in the efficiency of excavation by controlling the flow of excavated soil (or swarf) to flow upward.

FIG. 15 (*c*) and FIG. 15 (*d*) show the configuration examples in which the auxiliary bit is an external-blade. In the following descriptions, configurations substantially equivalent to those in the first embodiment are denoted by the same reference numerals as those in FIG. 1 (*a*) to FIG. 1 (*d*) and explanation on these configurations are omitted for the sake of simplifying explanations.

As shown in FIG. 15 (*c*) and FIG. 15 (*d*), an auxiliary bit 403 comprises a base portion 413. The rear end portion of the base portion 413 has an inclined portion 413*a*, which is inclined toward the rear in the excavation direction, in other words, toward the rear end of the twin bit 401. A carbide tip 413*b* is arranged on the inclined surface of the inclined portion 413*a*. A hole portion in communication with the hole portion 12 of the leg portions 5 and 6 is provided in the inclined portion 413*a*.

The base portion 413 has a mountain-shaped portion in which two apex portions of the respective top and bottom of the base portion 413 protrude in the excavation direction, in other words, toward the front end side of the twin bit 401. Carbide tips 414 and 415 are arranged on the two mountain-shaped portions on the respective top and bottom portions at the front end of the base portion 413.

More specifically, the carbide tip 414 comprises an inclined portion 414*a* and an inclined portion 414*b* at the top portion of the front end of the base portion 413. The inclined portion 414*a* rises at certain angles from a third plane portion 417 of the base portion 413 in the excavation direction, in other words, toward the apex portion. The inclined portion 414*b* rises at certain angles from the second plane portion 10 in the excavation direction, in other words, toward the apex portion. The length of the inclined portion 414*a* is shorter than the length of the inclined portion 414*b*. Thus, the apex portion is close to the third plane portion 417 of the auxiliary bit 403. In other words, the apex portion is located close to a side opposite to the main bit 402 side of the auxiliary bit 403 in the thickness direction. On the other hand, the carbide tip 415 comprises an inclined portion 415*a* and an inclined portion 415*b* at the bottom of the front end of the base portion 413. The inclined portion 415*a* rises at certain angles from the third plane portion 417 of the base portion 413 in the excavation direction, in other words, toward the apex portion. The inclined portion 415*b* rises at certain angles from the second plane portion 10 of the base portion 413 in the excavation direction, in other words, toward the apex portion. The length of the inclined portion 414*a* is shorter than the length of the inclined portion 414*b*. Thus, the apex portion is close to the third plane portion 417 of the auxiliary bit 403 in the excavation direction or the hole wall direction. In other words, the apex portion is located close to a side opposite to the main bit 402 side of the auxiliary bit 403 in the thickness direction.

The apex portion where the inclined portions 414*a* and 414*b* of the carbide tip 414 are continuous and the apex portion where the inclined portions 415*a* and 415*b* of the carbide tip 415 are continuous form edges for excavation at the respective top and bottom of the base portion 414. In addition, at the front end of the base portion 413, a recess portion 416 is formed between the carbide tips 414 and 415. The recess portion 416 not only further reduces the amount of build-up excavated soil (or swarf) but also contributes to the increase in the efficiency of excavation by controlling the flow of excavated soil (or swarf) to flow upward.

Figure 9:
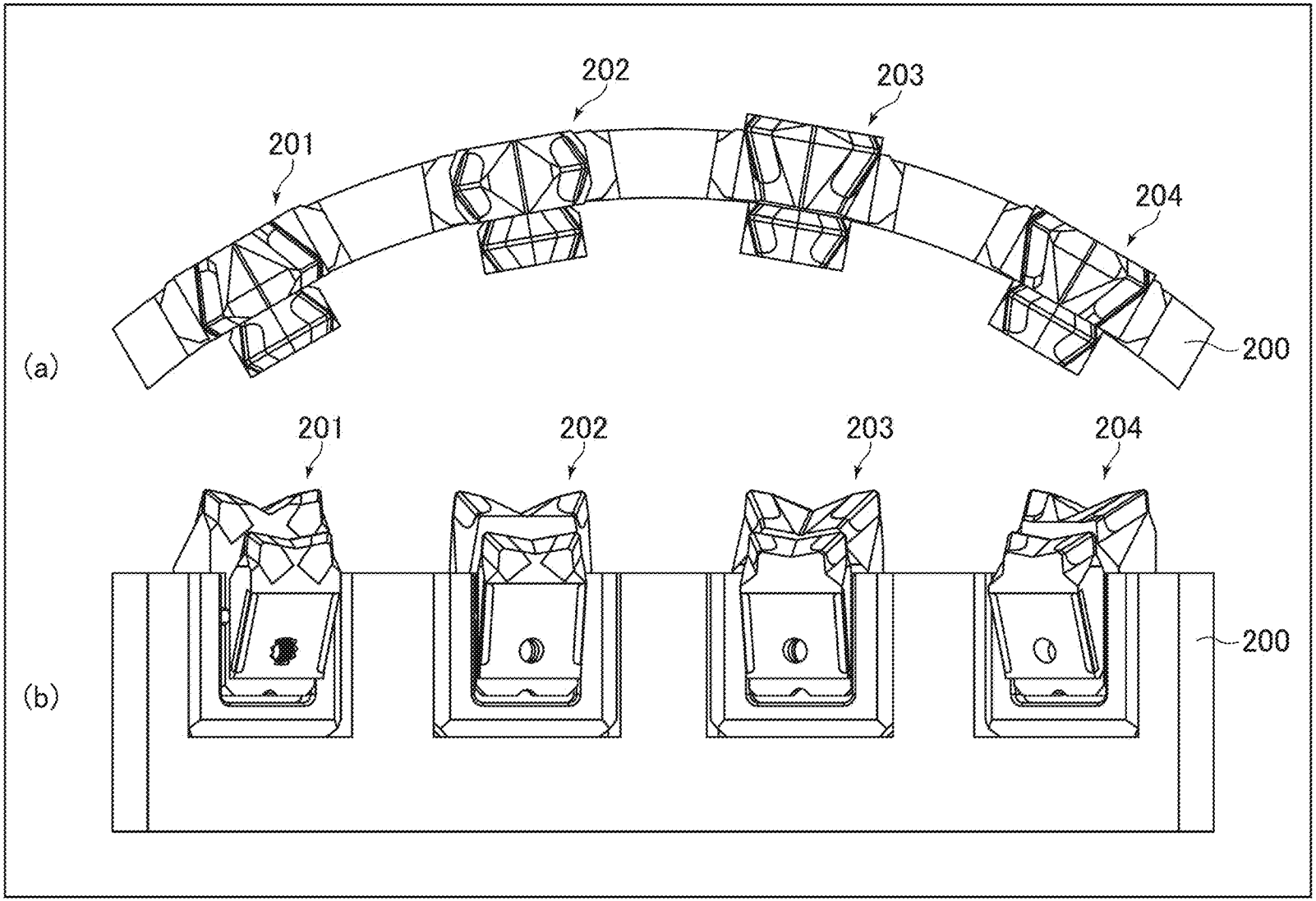
FIG. 9 is a view showing the twin bit attached to a casing.
Figure 13:
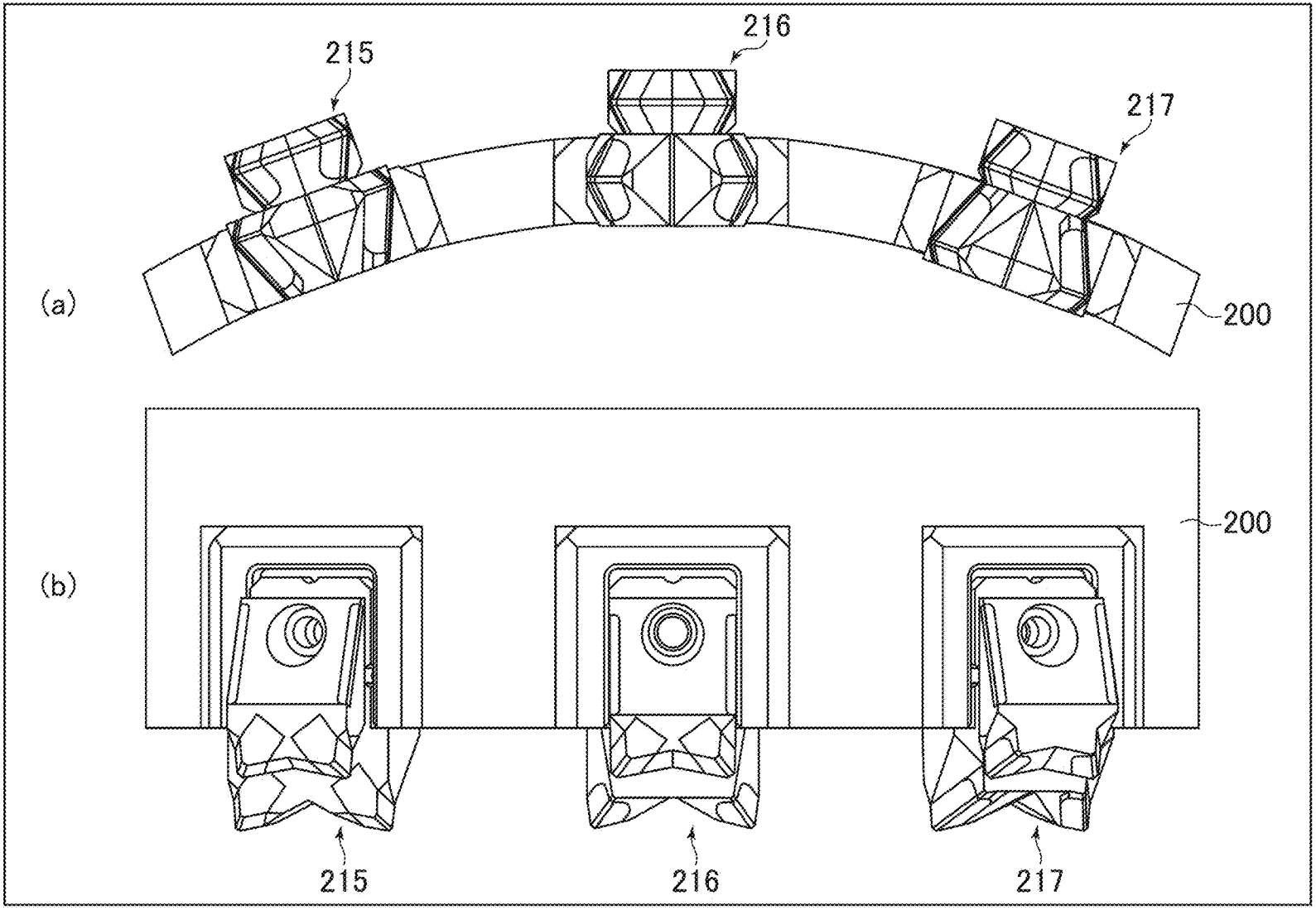
FIG. 13 is a view showing the twin bit attached to the casing.

Here, FIG. 9 (*a*), FIG. 9 (*b*) to FIG. 13 (*a*), and FIG. 13 (*b*) show and explain examples of attachment of the twin bit to the casing in the embodiments of the present invention.

FIG. 9 (*a*) and FIG. 9 (*b*) show examples of the attachment where the main bit is straight-shaped and is angled, and the auxiliary bit is attached to the inside. In these figures, a twin bit 201 comprising an inner-blade main bit and an external-blade auxiliary bit, a twin bit 202 comprising a middle-blade main bit and a middle-blade auxiliary bit, a twin bit 203 comprising an angled external-blade main bit and an inner-blade auxiliary bit, and a twin bit 204 comprising an external-blade main bit and an inner-blade auxiliary bit are attached to the casings 200, respectively.

Figure 10:
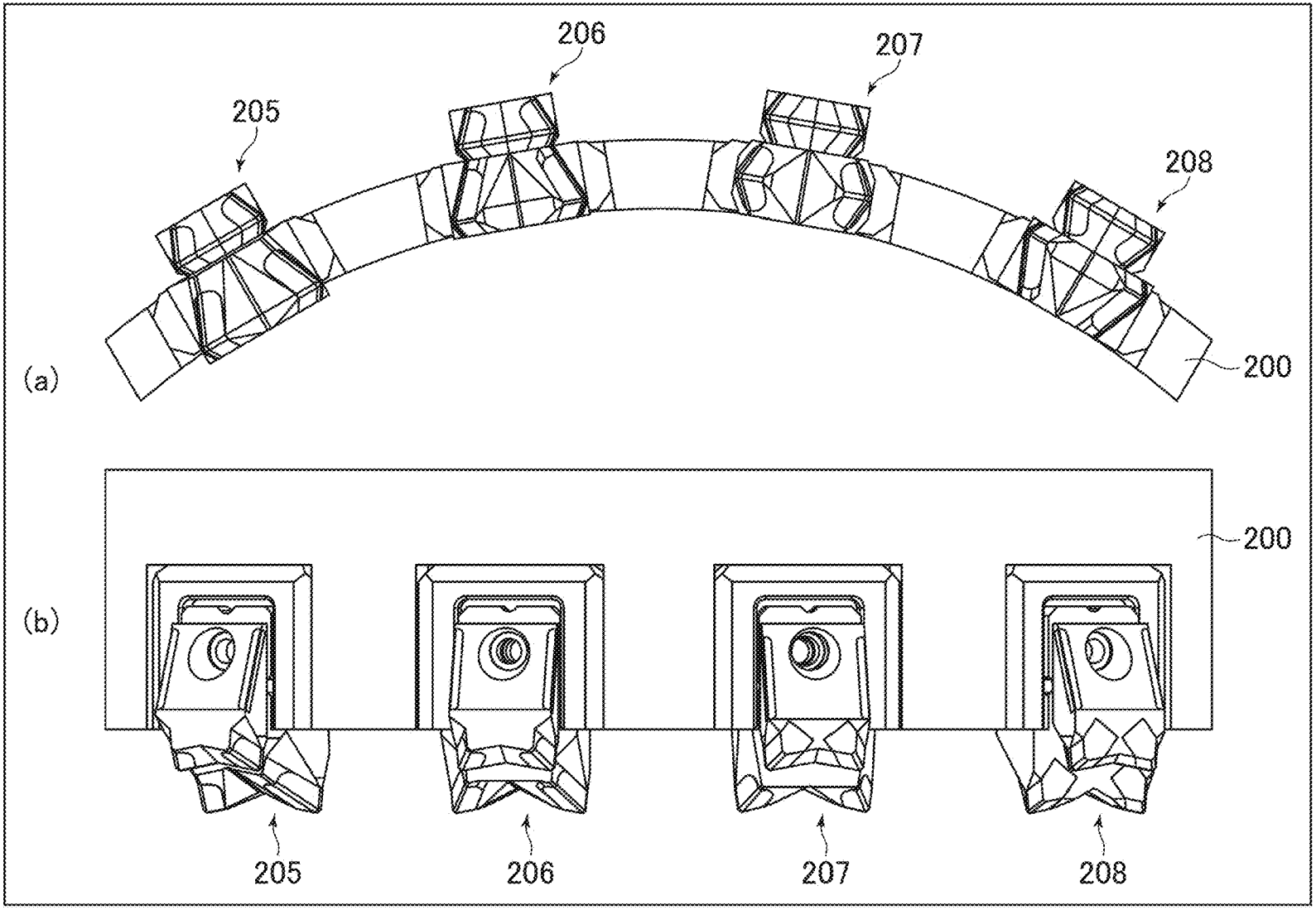
FIG. 10 is a view showing the twin bit attached to the casing.

FIG. 10 (*a*) and FIG. 10 (*b*) show examples of the attachment where the main bit is straight-shaped and is angled, and the auxiliary bit is attached to the outside. In these figures, a twin bit 205 comprising an angled external-blade main bit and an inner-blade auxiliary bit, a twin bit 206 comprising an external-blade main bit and an inner-blade auxiliary bit, a twin bit 207 comprising a middle-blade main bit and a middle-blade auxiliary bit, and a twin bit 208 comprising an inner-blade main bit and an external-blade auxiliary bit are attached to the casings 200, respectively.

Figure 11:
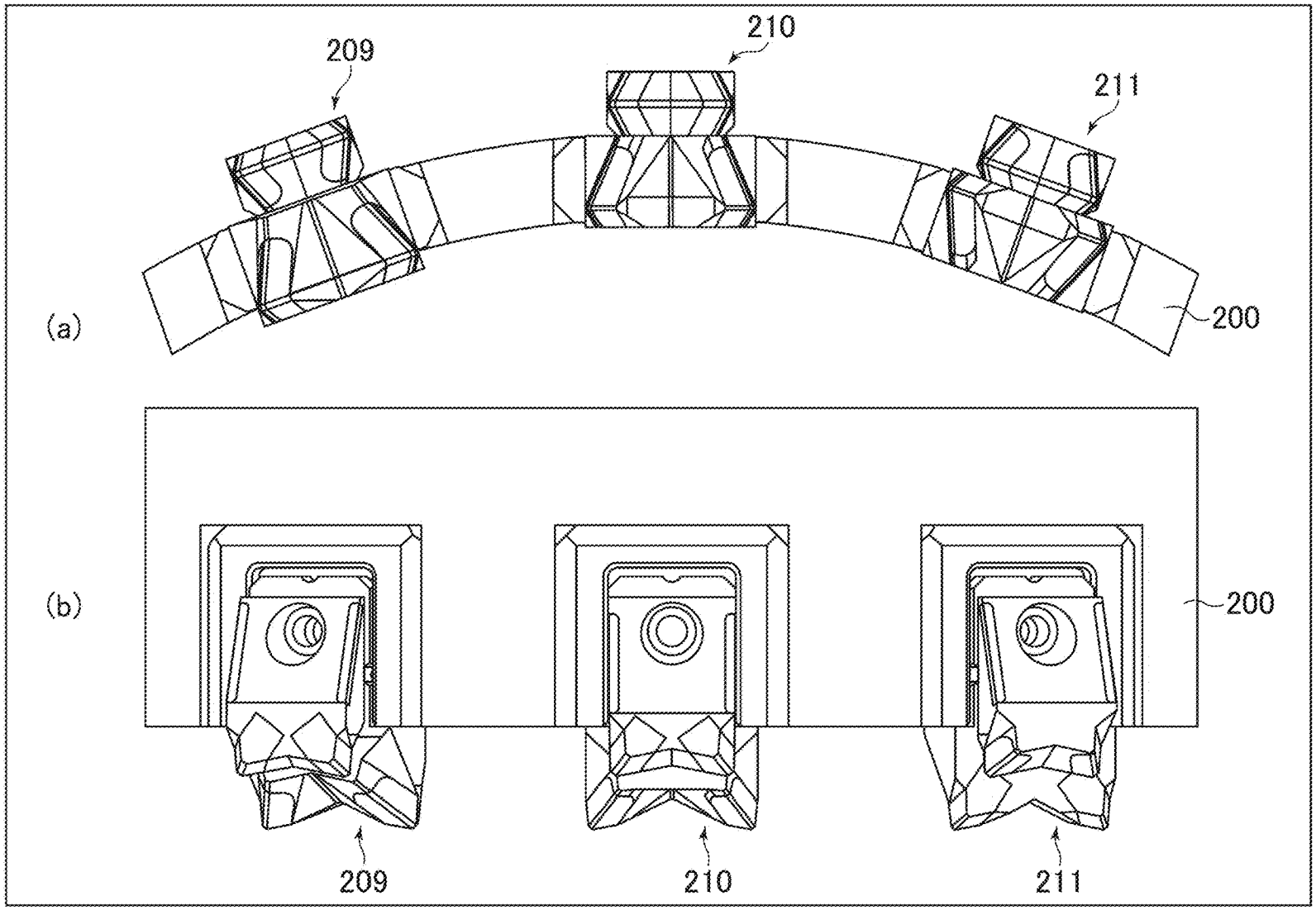
FIG. 11 is a view showing the twin bit attached to the casing.

FIG. 11 (*a*) and FIG. 11 (*b*) show examples of the attachment when the main bit is straight-shaped and the auxiliary bit is attached to the outside. In these figures, a twin bit 209 comprising an external-blade main bit and an external-blade auxiliary bit, a twin bit 210 comprising an external-blade main bit and a middle-blade auxiliary bit, and a twin bit 211 comprising a straight-shaped inner-blade main bit and an inner-blade auxiliary bit are attached to the casings 200, respectively.

Figure 12:
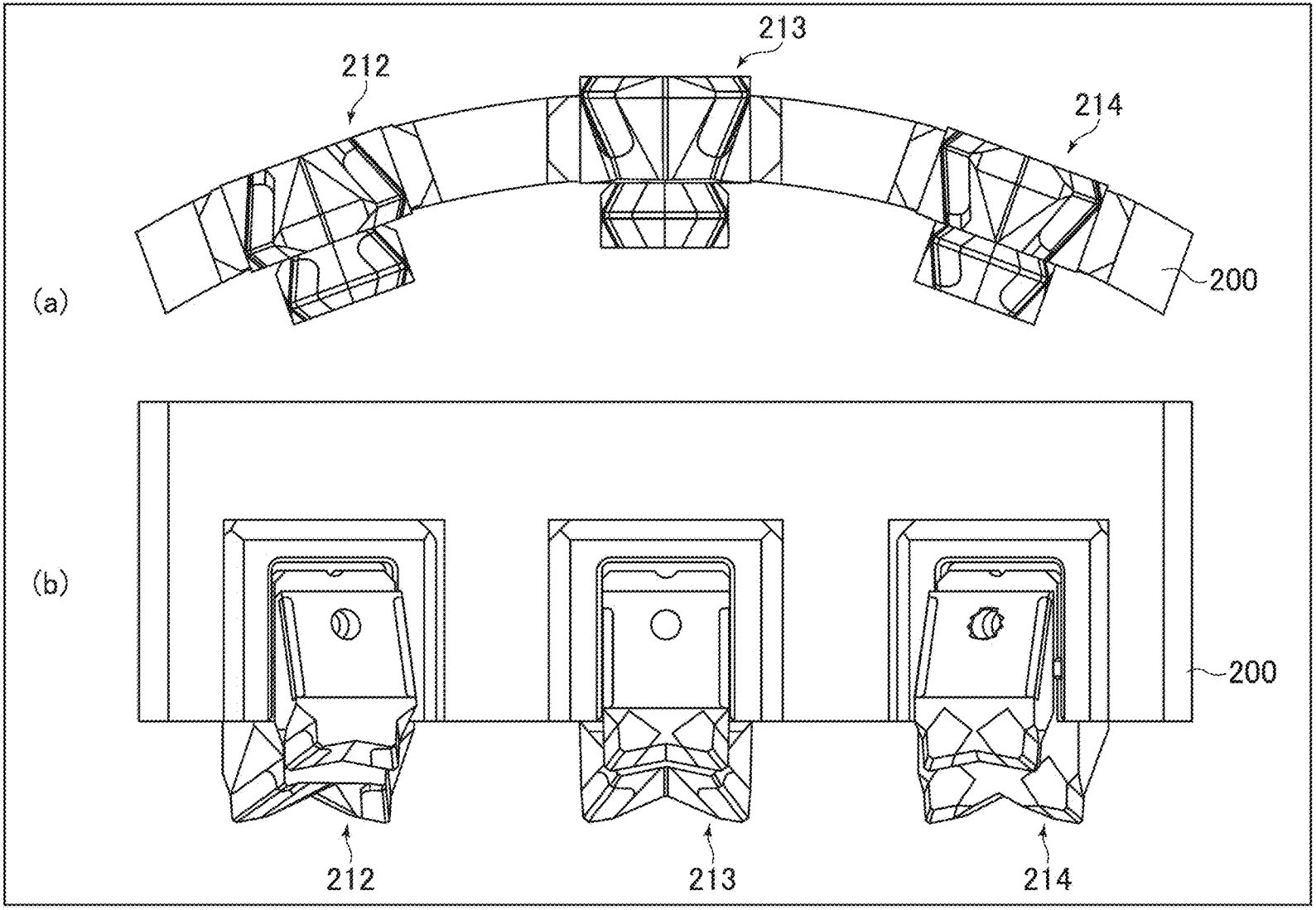
FIG. 12 is a view showing the twin bit attached to the casing.

FIG. 12 (*a*) and FIG. 12 (*b*) show examples of the attachment when the main bit is straight-shaped and the auxiliary bit is attached to the inside. In these figures, a twin bit 212 comprising an inner-blade main bit and an external-blade auxiliary bit, a twin bit 213 comprising an external-blade main bit and a middle-blade auxiliary bit, and a twin bit 214 comprising a straight-shaped external-blade main bit and an auxiliary bit inner-blade auxiliary bit are attached to the casings 200, respectively.

FIG. 13 (*a*) and FIG. 13 (*b*) show examples of the attachment where the main bit is straight-shaped or is angled, and the auxiliary bit is attached to the outside. In these figures, a twin bit 215 comprising an inner-blade main bit and an external-blade auxiliary bit, a twin bit 216 comprising an angled middle-blade main bit and a middle-blade auxiliary bit, and a twin bit 217 comprising an external-blade main bit and an inner-blade auxiliary bit are attached to the casings 200, respectively.

Figure 14:
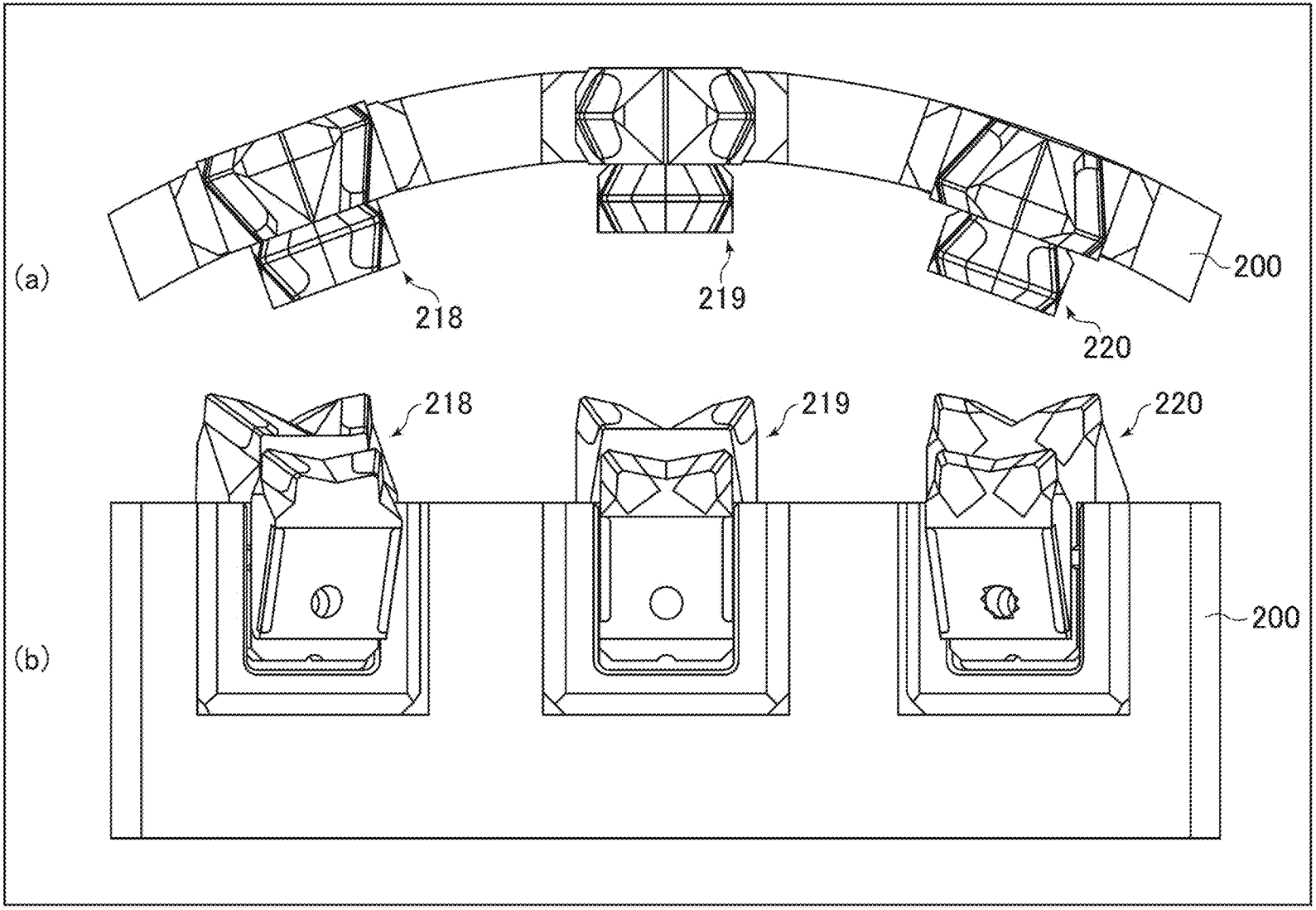
FIG. 14 is a view showing the twin bit attached to the casing.

FIG. 14 (*a*) and FIG. 14 (*b*) show examples of the attachment where the main bit is straight-shaped or angled, and the auxiliary bit is attached to the inside. In these figures, a twin bit 218 comprising an external-blade main bit and an inner-blade auxiliary bit, a twin bit 219 comprising an angled middle-blade main bit and a middle-blade auxiliary bit, and a twin bit 220 comprising an inner-blade main bit and an external-blade auxiliary bit are attached to the casings 200, respectively.

The twin bits described in the first to eighth embodiments can be configured as follows.

(a) Regarding the Cutting Edge Positions of the Main Bit and the Auxiliary Bit

In all of the shapes, the staggered configuration may be adopted in which the cutting edge of the auxiliary bit is positioned 25 mm below the cutting edge of the main bit. The reason that the cutting edge of the auxiliary bit is positioned 25 mm below the cutting edge of the main bit is to allow the auxiliary bit to perform excavation of positions that cannot be excavated by the main bit by the configuration in which the cutting edge of the auxiliary bit is 25 mm below the cutting edge of the main bit, which is the middle position of the distance (50 mm) between the cutting edge of the main bit and an end portion of the casing.

(b) Regarding the Width Settings of the Main Bit and the Auxiliary Bit

The width (80 mm) of the cutting edge of the main bit may be set such that the jaws of the cutting edge hang 10 mm in each of front and back portions of the holder and the entire width (60 mm) of the auxiliary bit fits exactly within the internal dimensions of the holder. As the primary shock during excavations is exerted on the main bit, the shock exerted on the auxiliary bit is expected to be reduced by approximately 30%. Therefore, the width ratio between the main bit and auxiliary bit can be set to 4:3. However, this width ratio can vary depending on the excavation target.

(c) Regarding the Thickness Settings of the Main Bit and the Auxiliary Bit

The thickness (40 mm) of the straight-shaped main bit is the most common thickness of the bit. Thus, the thickness of the straight-shaped main bit is set at 40 mm for versatility. Based on the same reason, the thickness (30 mm) of the auxiliary bit may be set to the ratio of 4:3. However, this thickness ratio can vary depending on the excavation target.

The thickness (50 mm) of the angled main bit is designed to excavate 10 mm outside or 10 mm inside the cutting edge position of the straight-shaped bit. Therefore, the thickness ratio of the auxiliary bit is set to the ratio of 5:3. However, this angled main bit maximizes its effect when being used together with the straight-shaped bit, and the primary impact exerted during the excavation is not simply 25% greater. The thickness of the angled main bit can vary depending on the excavation target.

(d) Regarding a Tapered Part of the Auxiliary Bit

The auxiliary bit is attached either inside or outside of the main bit and thus properly abuts the excavation target. Therefore, a carbide tip for impact and wear resistance is attached to the tapered portion of the auxiliary bit. The angle of the tapered portion varies depending on the thickness of the auxiliary bit.

(e) Regarding the Hardness of the Carbide Tip

The hardness of the carbide tips of both of the main and auxiliary bits can vary depending on the excavation target. As described above, with respect to the hardness of carbide tips, E7 to E2 (JIS standard; coarse grain type) of the common E types or G5 to G2 (JIS standard; medium grain type) may be adopted. The hardnesses of the carbide tips of the main bit and the auxiliary bit may be different from each other.

For example, in cases of excavation target is hard rock; the main bit E2+the auxiliary bit E3.

For example, in cases of obstacle removal reinforced, concrete such as beams, columns, and floors; main bit E6+auxiliary bit E5.

As explained above, the following effects are achieved by the embodiments of the present invention.

The embodiments of the present invention can provide the twin bit that comprises a main bit and an auxiliary bit wherein a carbide tip having a mountain shape protruding in an excavation direction is arranged at least on a top portion and a bottom portion that are located on a front end of a base portion of each of the main bit and the auxiliary bit, and wherein an apex portion of the mountain shape of the carbide tip of the auxiliary bit is located further behind the apex portion of the mountain shape of the carbide tip of the main bit in the excavation direction. Here, the apex portion of the mountain shape of the main bit may be located closer to a hole wall direction or a pile core direction, or is located at a center, the hole wall direction and the pile core direction being orthogonal to the excavation direction. The apex portion of the mountain shape of the auxiliary bit may be located closer to a hole wall direction or a pile core direction, or is located at a center, the hole wall direction and the pile core direction being orthogonal to the excavation direction. The main bit further comprises two leg portions continuous to the base portion, and an outer surface of the leg portion on a side on which the auxiliary bit is not installed may have a predetermined inclination.

Therefore, first, by the staggered configuration in which the main bit and the auxiliary bit are installed to be next to each other in a direction orthogonal to the excavation direction, and the cutting edge of the auxiliary bit is located on the rear in the excavation direction, it is possible to reduce the load on the inner (or outer) plate of the casing, prevent the build-up of excavation soil (or swarf) that occurs in the excavation with a single cutting edge, and increase the efficiency of the excavation.

Secondly, by making the base portion shape of the cutting edge of the main bit selectable from either a straight shape or an inclined shape in which the base material is angled and by making the positions of the cutting edges of the main bit and auxiliary bit adjustable, widths and angles in excavation positions of both cutting edges, the excavation position of the cutting edge can be set. Thus, the excavation position of the cutting edges cat be broadened, the load on the inner plate (or outer plate) of the casing is further reduced, and not only the build-up of the excavated soil (or swarf) can be further reduced but also the flow of the excavated soil (or swarf) can be controlled to move upwards.

Thirdly, the arrangement of carbide tip on the cutting edge of the base portion (the base material) can improve wear resistance.

Fourthly, as the twin bit can rotate in both directions, excavate in both forward and reverse directions can be performed.

The above explanations on the embodiments of the present invention do not limit the present invention. The present invention can be modified and changed in various ways within the scope of not deviating from the purpose of this invention as a matter of course.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A twin bit, comprising:

a main bit; and an auxiliary bit, wherein a first carbide tip having a mountain shape protruding in an excavation direction is arranged at least on a top portion and a bottom portion that are located on a front end of a first base portion of the main bit, a second carbide tip having a mountain shape protruding in the excavation direction is arranged at least on a top portion and a bottom portion that are located on a front end of a second base portion of the auxiliary bit, the main bit further has a first plane portion and a second plane portion located on an opposite side of the first plane portion in an orthogonal direction to the excavation direction, the auxiliary bit further has a third plane portion in the orthogonal direction, in the orthogonal direction, the third plane portion, the second plane portion, and the first plane portion are arranged in order such that the second plane portion is disposed between the third plane portion and the first plane portion, the second plane portion is arranged between the first carbide tip and the second carbide tip, and an apex portion of the mountain shape of the second carbide tip of the auxiliary bit is located further behind an apex portion of the mountain shape of the first carbide tip of the main bit in the excavation direction.

2. The twin bit of claim 1, wherein at least one of:

in the orthogonal direction, a distance between the apex portion of the mountain shape of the first carbide tip of the main bit and the first plane portion is shorter than a distance between the apex portion of the mountain shape of the first carbide tip of the main bit and the second plane portion, in the orthogonal direction, the distance between the apex portion of the mountain shape of the first carbide tip of the main bit and the first plane portion is longer than the distance between the apex portion of the mountain shape of the first carbide tip of the main bit and the second plane portion, or in the orthogonal direction, the distance between the apex portion of the mountain shape of the first carbide tip of the main bit and the first plane portion is equal to the distance between the apex portion of the mountain shape of the first carbide tip of the main bit and the second plane portion.

3. The twin bit of claim 2, wherein at least one of:

in the orthogonal direction, a distance between the apex portion of the mountain shape of the second carbide tip of the auxiliary bit and the second plane portion is shorter than a distance between the apex portion of the mountain shape of the second carbide tip of the auxiliary bit and the third plane portion, in the orthogonal direction, the distance between the apex portion of the mountain shape of the second carbide tip of the auxiliary bit and the second plane portion is longer than the distance between the apex portion of the mountain shape of the second carbide tip of the auxiliary bit and the third plane portion, or in the orthogonal direction, the distance between the apex portion of the mountain shape of the second carbide tip of the auxiliary bit and the second plane portion is equal to the distance between the apex portion of the mountain shape of the second carbide tip of the auxiliary bit and the third plane portion.

4. The twin bit of claim 3, wherein the main bit further comprises two leg portions continuous to the first base portion, and an outer surface of the leg portion on a side on which the auxiliary bit is not installed has a predetermined inclination.

5. The twin bit of claim 1, wherein at least one of:

in the orthogonal direction, a distance between the apex portion of the mountain shape of the second carbide tip of the auxiliary bit and the second plane portion is shorter than a distance between the apex portion of the mountain shape of the second carbide tip of the auxiliary bit and the third plane portion, in the orthogonal direction, the distance between the apex portion of the mountain shape of the second carbide tip of the auxiliary bit and the second plane portion is longer than the distance between the apex portion of the mountain shape of the second carbide tip of the auxiliary bit and the third plane portion, or in the orthogonal direction, the distance between the apex portion of the mountain shape of the second carbide tip of the auxiliary bit and the second plane portion is equal to the distance between the apex portion of the mountain shape of the second carbide tip of the auxiliary bit and the third plane portion.

6. The twin bit of claim 5, wherein the main bit further comprises two leg portions continuous to the first base portion, and an outer surface of the leg portion on a side on which the auxiliary bit is not installed has a predetermined inclination.

* * * * *